US007667122B2

(12) United States Patent
Saijo

(10) Patent No.: US 7,667,122 B2
(45) Date of Patent: Feb. 23, 2010

(54) MOTION DATA GENERATION DEVICE, MOTION DATA GENERATION METHOD, AND RECORDING MEDIUM FOR RECORDING A MOTION DATA GENERATION PROGRAM

(75) Inventor: Hiroki Saijo, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/370,191

(22) Filed: Feb. 12, 2009

(65) Prior Publication Data

US 2009/0145284 A1 Jun. 11, 2009

Related U.S. Application Data

(63) Continuation of application No. 11/904,500, filed on Sep. 27, 2007, now Pat. No. 7,528,313.

(30) Foreign Application Priority Data

Oct. 2, 2006 (JP) ..... 2006-271330

(51) Int. Cl.
*G10H 1/40* (2006.01)

(52) U.S. Cl. ..... 84/611; 84/601; 84/604; 84/609; 84/615; 84/616

(58) Field of Classification Search ..... None
See application file for complete search history.

(56) References Cited

U.S. PATENT DOCUMENTS 5,808,219 A * 9/1998 Usa ..... 84/600
2003/0069669 A1 4/2003 Yamaura
2004/0000225 A1* 1/2004 Nishitani et al. ..... 84/610
2006/0060068 A1* 3/2006 Hwang et al. ..... 84/615
2006/0101985 A1 5/2006 Decuir

FOREIGN PATENT DOCUMENTS

EP 0228895 A2 7/1987
FR 2609902 A1 7/1988
JP 2002-086378 A 3/2002
JP 2005-231012 * 9/2005

* cited by examiner

*Primary Examiner*—Marlon T Fletcher
(74) *Attorney, Agent, or Firm*—Wolf, Greenfield & Sacks, P.C.

(57) ABSTRACT

To generate motion data of a motion in synchronization with a melody of music. As an embodiment of the present invention, when motion pattern data corresponding to a predetermined motion pattern is stored, music data is analyzed to detect a beat of music based on the music data, and the music data is divided into a plurality of bar intervals based on the detected beat, the motion pattern data is allocated to the bar intervals of the music data being divided to generate motion data. In this manner, when the motion data is reproduced together with the music data, the motion pattern can be switched in synchronization with switching of first bar intervals and second bar intervals corresponding to a bar when the music based on music data is expressed in a musical score.

9 Claims, 19 Drawing Sheets

ADB FIRST MOTION PATTERN DATABASE

| | CHARACTERISTIC 1 | ····· | CHARACTERISTIC N |
|---|---|---|---|
| ENCLOSURE RIGHT ROTATIONAL PART | FIRST MOTION PATTERN DATA $AD_{a11}$<br>FIRST MOTION PATTERN DATA $AD_{a12}$<br>⋮ | ····· | FIRST MOTION PATTERN DATA $AD_{aN1}$<br>FIRST MOTION PATTERN DATA $AD_{aN2}$<br>⋮ |
| ENCLOSURE LEFT ROTATIONAL PART | FIRST MOTION PATTERN DATA $AD_{b11}$<br>FIRST MOTION PATTERN DATA $AD_{b12}$<br>⋮ | ····· | FIRST MOTION PATTERN DATA $AD_{bN1}$<br>FIRST MOTION PATTERN DATA $AD_{bN2}$<br>⋮ |
| ENCLOSURE RIGHT OPENING/ CLOSING PART | FIRST MOTION PATTERN DATA $AD_{c11}$<br>FIRST MOTION PATTERN DATA $AD_{c12}$<br>⋮ | ····· | FIRST MOTION PATTERN DATA $AD_{cN1}$<br>FIRST MOTION PATTERN DATA $AD_{cN2}$<br>⋮ |
| ENCLOSURE LEFT OPENING/ CLOSING PART | FIRST MOTION PATTERN DATA $AD_{d11}$<br>FIRST MOTION PATTERN DATA $AD_{d12}$<br>⋮ | ····· | FIRST MOTION PATTERN DATA $AD_{dN1}$<br>FIRST MOTION PATTERN DATA $AD_{dN2}$<br>⋮ |
| RIGHT WHEEL | FIRST MOTION PATTERN DATA $AD_{e11}$<br>FIRST MOTION PATTERN DATA $AD_{e12}$<br>⋮ | ····· | FIRST MOTION PATTERN DATA $AD_{eN1}$<br>FIRST MOTION PATTERN DATA $AD_{eN2}$<br>⋮ |
| LEFT WHEEL | FIRST MOTION PATTERN DATA $AD_{f11}$<br>FIRST MOTION PATTERN DATA $AD_{f12}$<br>⋮ | ····· | FIRST MOTION PATTERN DATA $AD_{fN1}$<br>FIRST MOTION PATTERN DATA $AD_{fN2}$<br>⋮ |

AD FIRST MOTION PATTERN DATA

FIG.8

BDB SECOND MOTION PATTERN DATABASE

| | CHARACTERISTIC 1 | ····· | CHARACTERISTIC N |
|---|---|---|---|
| ENCLOSURE RIGHT ROTATIONAL PART | SECOND MOTION PATTERN DATA $BD_{a11}$<br>SECOND MOTION PATTERN DATA $BD_{a12}$<br>⋮ | ····· | SECOND MOTION PATTERN DATA $BD_{aN1}$<br>SECOND MOTION PATTERN DATA $BD_{aN2}$<br>⋮ |
| ENCLOSURE LEFT ROTATIONAL PART | SECOND MOTION PATTERN DATA $BD_{b11}$<br>SECOND MOTION PATTERN DATA $BD_{b12}$<br>⋮ | ····· | SECOND MOTION PATTERN DATA $BD_{bN1}$<br>SECOND MOTION PATTERN DATA $BD_{bN2}$<br>⋮ |
| ENCLOSURE RIGHT OPENING/ CLOSING PART | SECOND MOTION PATTERN DATA $BD_{c11}$<br>SECOND MOTION PATTERN DATA $BD_{c12}$<br>⋮ | ····· | SECOND MOTION PATTERN DATA $BD_{cN1}$<br>SECOND MOTION PATTERN DATA $BD_{cN2}$<br>⋮ |
| ENCLOSURE LEFT OPENING/ CLOSING PART | SECOND MOTION PATTERN DATA $BD_{d11}$<br>SECOND MOTION PATTERN DATA $BD_{d12}$<br>⋮ | ····· | SECOND MOTION PATTERN DATA $BD_{dN1}$<br>SECOND MOTION PATTERN DATA $BD_{dN2}$<br>⋮ |
| RIGHT WHEEL | SECOND MOTION PATTERN DATA $BD_{e11}$<br>SECOND MOTION PATTERN DATA $BD_{e12}$<br>⋮ | ····· | SECOND MOTION PATTERN DATA $BD_{eN1}$<br>SECOND MOTION PATTERN DATA $BD_{eN2}$<br>⋮ |
| LEFT WHEEL | SECOND MOTION PATTERN DATA $BD_{f11}$<br>SECOND MOTION PATTERN DATA $BD_{f12}$<br>⋮ | ····· | SECOND MOTION PATTERN DATA $BD_{fN1}$<br>SECOND MOTION PATTERN DATA $BD_{fN2}$<br>⋮ |

BD SECOND MOTION PATTERN DATA

FIG.9

MOTION DATA GENERATION DEVICE, MOTION DATA GENERATION METHOD, AND RECORDING MEDIUM FOR RECORDING A MOTION DATA GENERATION PROGRAM

CROSS REFERENCES TO RELATED APPLICATIONS

This application is a Continuation of U.S. application Ser. No. 11/904,500, filed on Sep. 27, 2007, which, in turn, claims priority Japanese Patent Application JP2006-271330 filed in the Japanese Patent Office on Oct. 2, 2006, the entire contents of which being incorporated herein by reference.

BACKGROUND OF THE INVENTION

1. Field of the Invention

The present invention relates to a motion data generation device, a motion data generation method, and a recording medium for recording a motion data generation program, and is preferably applied to a music robot device having a reproducing function of music data, for example.

2. Description of the Related Art

A conventional robot device generates motion pattern data by imaging a motion of a hand of a person, and stores the generated motion pattern data after classifying the generated motion pattern into clusters by each speed of the motion. When music data is provided, the robot device detects a tempo of music and reads out the motion pattern data from the clusters classified into the motion pattern data of a fast motion when the detected tempo is fast, and at the same time, the robot device moves with a fast motion (that is, dances with a fast motion) in accordance with the read-out motion pattern data so as to overlap with reproducing of the music based on the music data. On the other hand, when the tempo of the provided music data is slow, the robot device reads out the motion pattern data from the clusters classified into the motion pattern data of a slow motion, and at the same time, the robot device moves with a slow motion (that is, dances with a slow motion) in accordance with the read-out motion pattern data so as to overlap with playing of the music based on music data MD1 (For example, refer to Jpn. Pat. Appln. Publication No. 2005-231012).

SUMMARY OF THE INVENTION

The robot device can move in accordance with a melody of music, and also can naturally synchronize the motion with the music. In this manner, the robot device can be seen as though the robot device itself is dancing in accordance with the music.

However, the robot device of the above configuration merely reads out motion pattern data of a fast or a slow motion depending on whether a tempo of the music is fast or slow. Therefore, there has been a problem that created data does not move the robot device in synchronization with the melody of the music.

The present invention is made in consideration of the above point, and achieves a motion data generation device, a motion data generation method, and a motion data generation program that can generate motion data of a motion in synchronization with the melody of the music.

In order to achieve the above object, according to an aspect of the present invention, there is provided a storage unit that stores motion pattern data corresponding to a predetermined motion pattern, a beat detection unit that analyses music data and detects a beat (meter) of music based on the music data, an interval dividing unit that divides the music data into a plurality of beat intervals based on the beat detected by the beat detection unit, a data allocation unit that allocates the motion pattern data stored in the storage unit to the beat intervals of the music data divided by the interval dividing unit, and a data generation unit that generates motion data in accordance with the motion pattern data allocated to the beat intervals of the music data by the data allocation unit.

Therefore, in the present invention, when motion pattern data corresponding to a predetermined motion pattern is stored, music data is analyzed, a beat of music based on the music data is detected, and the music data is divided into a plurality of beat intervals based on the detected beat, motion data is generated in accordance with allocation of the motion pattern data to the beat intervals of the divided music data. Accordingly, the motion pattern can be switched in accordance with a melody of the music based on the beat intervals of the music data.

According to the present invention, when the motion pattern data corresponding to the predetermined motion pattern is stored, the music data is analyzed, the beat of music based on the music data is detected, and the music data is divided into a plurality of the beat intervals based on the detected beat, the motion data is generated in accordance with the allocation of the motion pattern data to the beat intervals of the divided music data. Accordingly, the motion pattern can be switched in accordance with the melody of the music based on the beat intervals of the music data. In this manner, a motion data generation device, a motion data generation method, and a motion data generation program that can generate motion data of a motion in synchronization with the melody of the music can be achieved.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 8 is a table showing a configuration of a first motion pattern database;

FIG. 9 is a table showing a configuration of a second motion pattern database;

DETAILED DESCRIPTION OF PREFERRED EMBODIMENTS

An embodiment of the present invention will be described in detail with the accompanying drawings.

(1) Summary of the Present Embodiments

Figure 1:
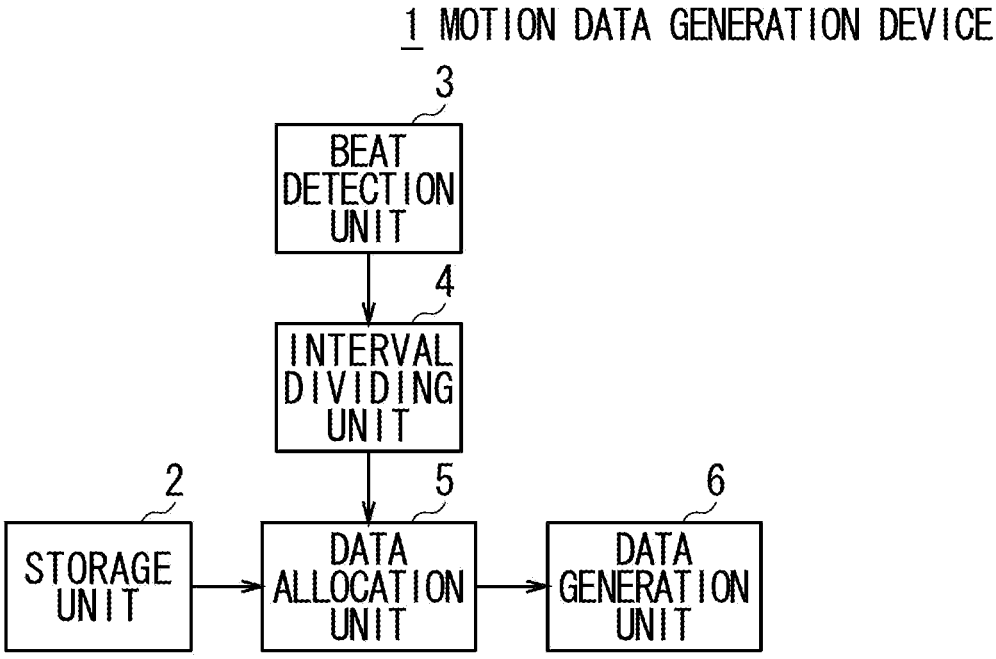
FIG. 1 is a block diagram showing an outline of a motion data generation device according to the present embodiment.

In FIG. 1, the numerical number 1 shows an outline of an entire configuration of a motion data generation device according to an embodiment of the present invention. A storage unit 2 of the motion data generation device 1 stores motion pattern data corresponding to a predetermined motion pattern. In addition, a beat detection unit 3 in the motion data generation device 1 analyzes music data and detects a beat of music based on the music data. Further, an interval dividing unit 4 in the motion data generation device 1 divides the music data into a plurality of beat intervals based on the beat detected by the beat detection unit 3. Further, a data allocation unit 5 in the motion data generation device 1 allocates the motion pattern data stored in the storage unit 2 to the beat intervals of the music data divided by the interval dividing unit 4. Further, a data generation unit 6 in the motion data generation device 1 generates motion data in accordance with the motion pattern data allocated to the beat intervals of the music data by the data allocation unit 5. By the above configuration, the motion data generation device 1 can switch the motion pattern in accordance with a melody of the music based on the beat intervals of the music data. In this manner, a motion data generation device, a motion data generation method, and a motion data generation program that can generate the motion data of a motion in synchronization with the melody of the music can be achieved.

(2) Configuration of Music Reproducing System

Figure 2:
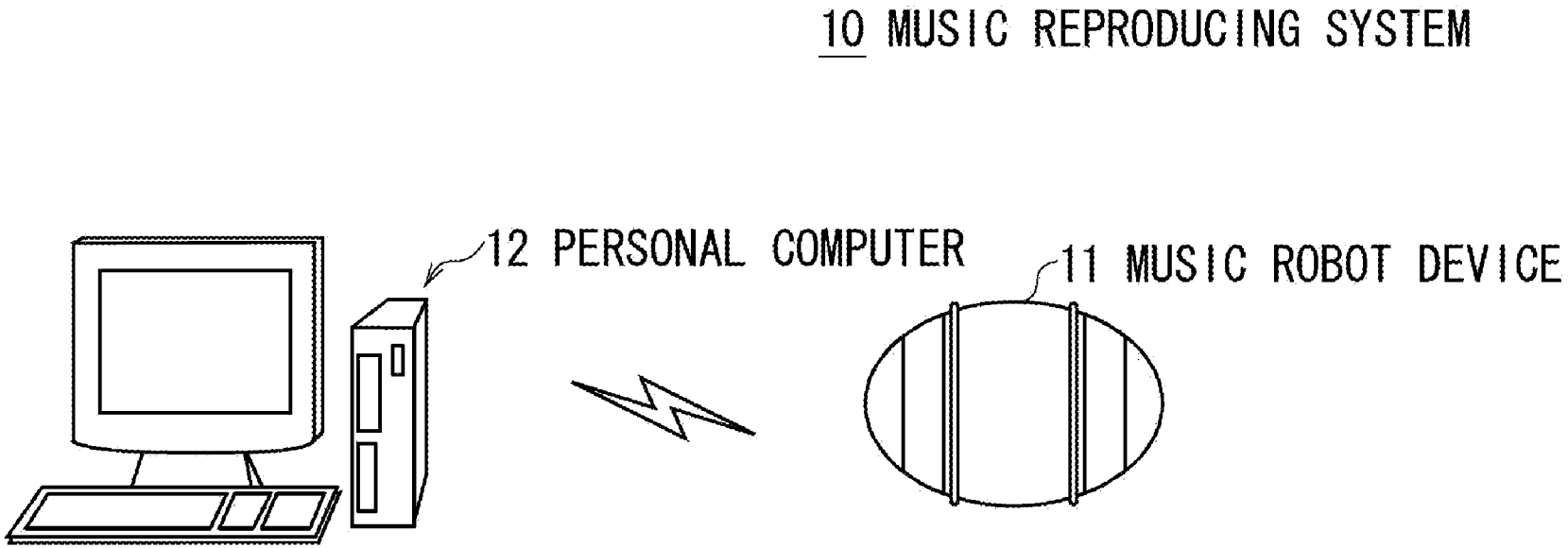
FIG. 2 is a schematic diagram showing a configuration of a music reproducing system.

In FIG. 2, the numerical number 10 shows an entire music reproducing system. The music reproducing system 10 is configured so as to be able to wireless-connect a music robot device 11 to which the present invention is applied and a personal computer 12 in conformity with, for example, Bluetooth (registered trademark) that is a short distance wireless communication technique.

(2-1) Configuration of Music Robot Device

Figure 3A:
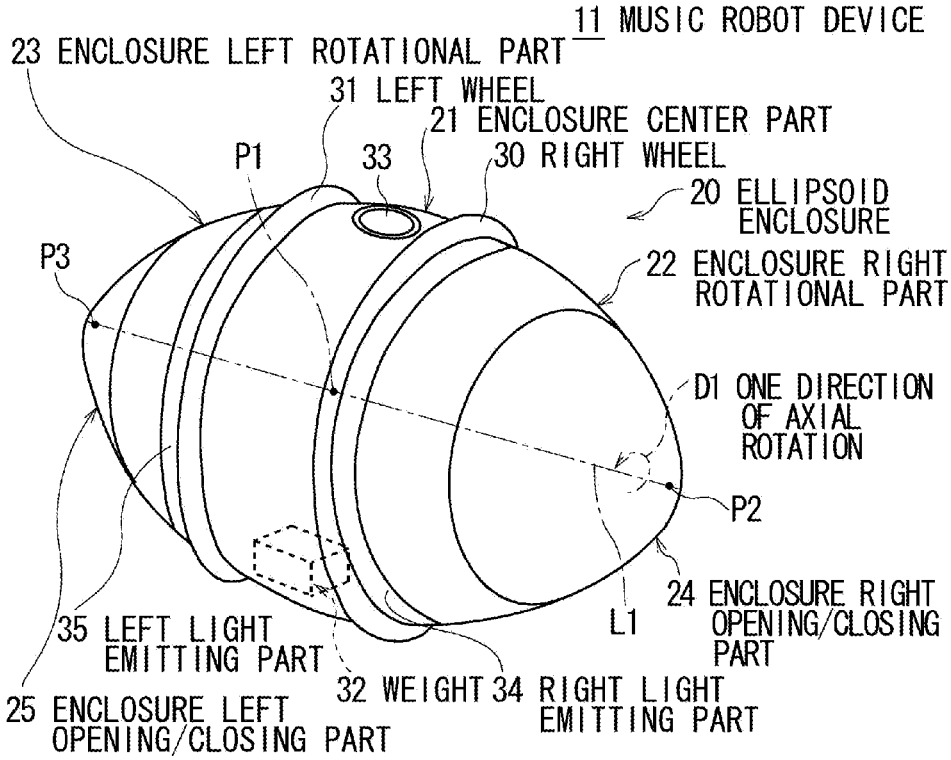
FIGS. 3A and 3B are schematic perspective views showing an outline configuration of a music robot device.
Figure 3B:
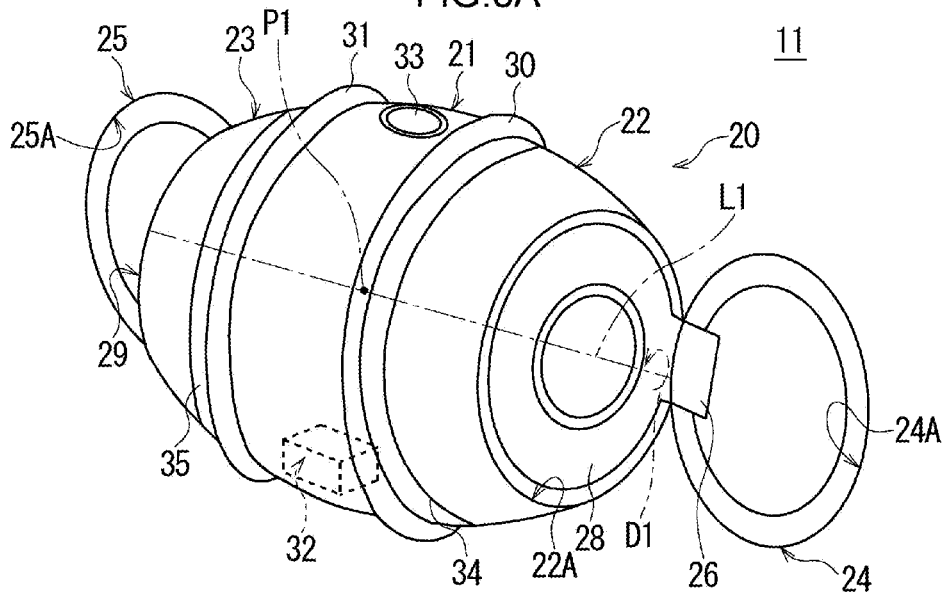
Figure 4:
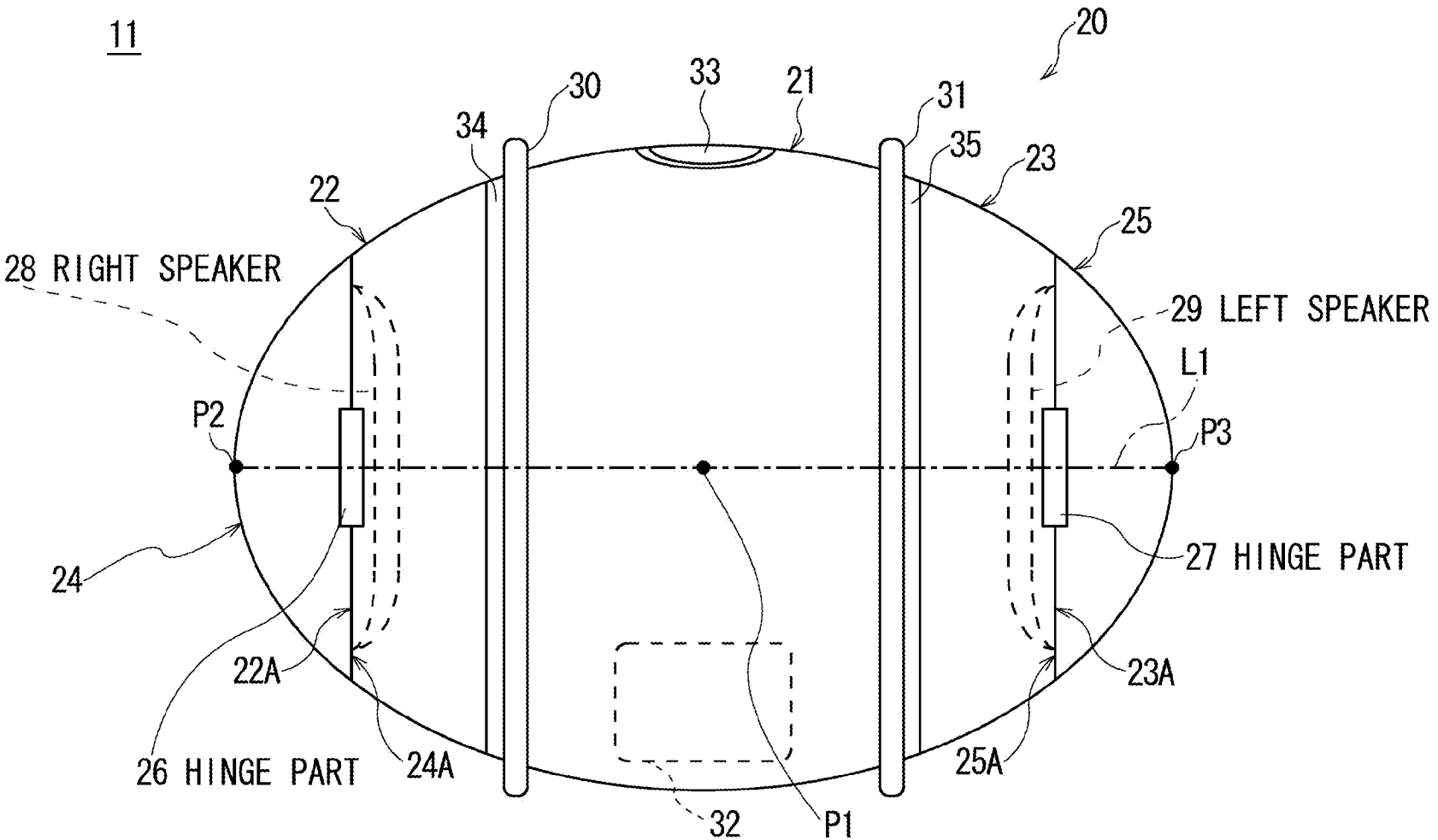
FIG. 4 is a schematic diagram showing a rear surface configuration of the music robot device.

First, a configuration of the music robot device 11 will be described. As shown in FIGS. 3A, 3B, and 4, the music robot device 11 has a device enclosure (hereinafter referred to as an ellipsoid enclosure) 20 having a substantial ellipsoid shape as an entire shape, for example. The ellipsoid enclosure 20 has a first enclosure rotational part (hereinafter referred to as an enclosure right rotational part) 22 which is a substantial truncated cone part provided on a side of one end part (hereinafter referred to as a right end part) of a pair of end parts facing each other on an enclosure center part 21 which is a barrel-shaped part in the center of the ellipsoid enclosure 20. In addition, the ellipsoid enclosure 20 has a second enclosure rotational part (hereinafter referred to as an enclosure left rotational part) 23 which is a substantial truncated cone part provided on a side of the other end part (hereinafter referred to as a left end part) of the enclosure center part 21.

Further, the ellipsoid enclosure 20 has a first enclosure opening/closing part (hereinafter referred to as an enclosure right opening/closing part) 24 which is a substantial cap shape part provided on a right side of the enclosure right rotational part 22. Further, the ellipsoid enclosure 20 has a second enclosure opening/closing part (hereinafter referred to as an enclosure left opening/closing part) 25 which is a substantial cap shape part provided on a left side of the enclosure left rotational part 23.

Then, when a line segment (that is, a major axis of the ellipsoid) that connects a center point P1 of the ellipsoid enclosure 20 and both vertexes P2 and P3 on a far right side and a far left side on a surface of the ellipsoid enclosure 20 is a horizontal rotational axis line L1, the enclosure right rotational part 22 is held in a manner rotatable in one axial direction D1 and the other axial direction opposite thereto centering on the horizontal rotational axis line L1 with respect to the right end part of the enclosure center part 21. In addition, the enclosure left rotational part 23 is held in a manner rotatable in one axial direction D1 and the other axial direction opposite thereto centering on the horizontal rotational axis line L1 with respect to the left end part of the enclosure center part 21.

Figure 5:
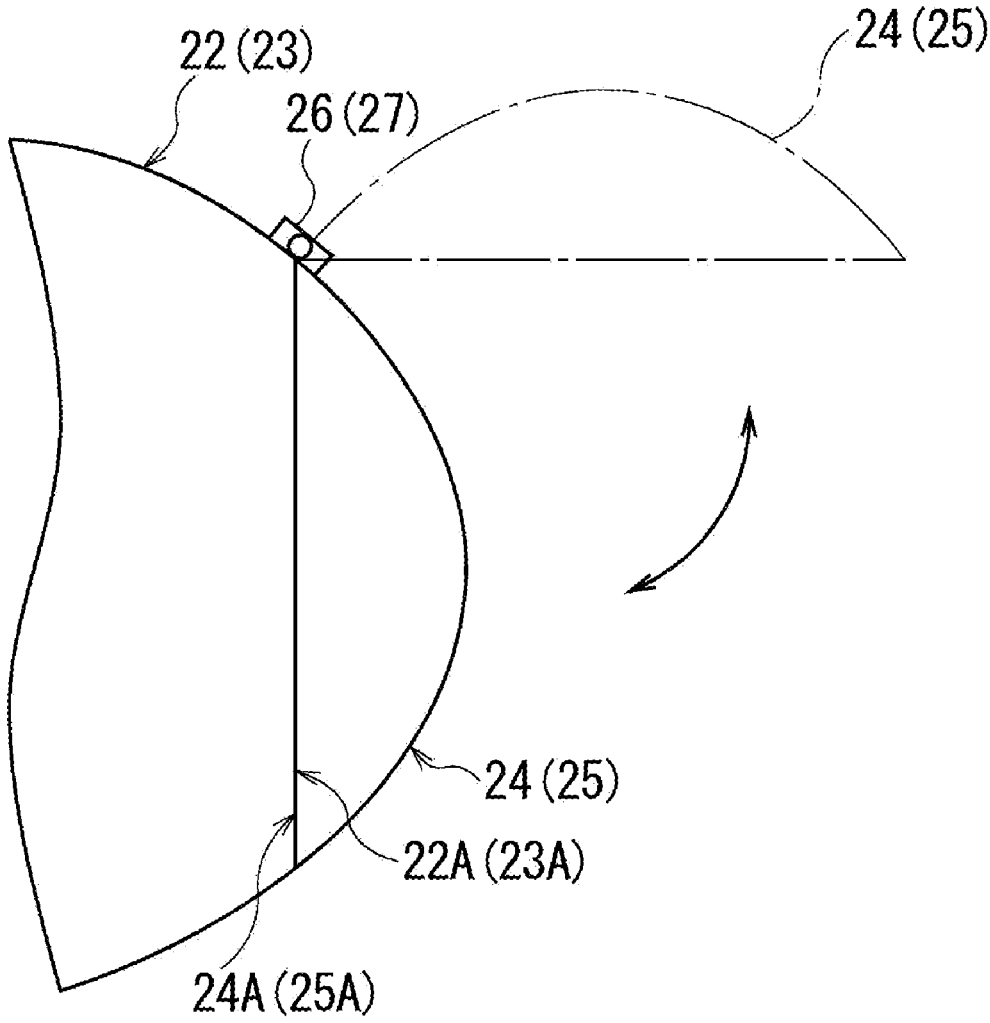
FIG. 5 is a schematic diagram used for explaining a state of opening and closing of an enclosure right opening/closing unit and an enclosure left opening/closing unit.

Further, as shown in FIG. 5, the enclosure right opening/closing part 24 is attached to the enclosure right rotational part 22 in a manner openable/closable in a predetermined angular range via a hinge part 26 provided on a predetermined position of a right edge part 22A of the enclosure right rotational part 22. The enclosure right opening/closing part 24 is configured so as to be opened in any angle in the predetermined angular range between a position where an aperture edge part 24A is made in contact with the right edge part 22A of the enclosure right rotational part 22 and a position where an opening angle between the right edge part 22A and the aperture edge part 24A is substantially 90 degrees and so on. On the other hand, the enclosure left opening/closing part 25 is attached to the enclosure left rotational part 23 in a manner openable/closable in a predetermined angular range via a hinge part 27 provided on a predetermined position of a left edge part 23A of the enclosure left rotational part 23. The enclosure left opening/closing part 25 is configured so as to be opened in any angle in the predetermined angular range between a position where an aperture edge part 25A is made in contact with the left edge part 23A and a position where an opening angle between the left edge part 23A and the aperture edge part 25A is substantially 90 degrees and so on.

Further, the enclosure right rotational part 22 is formed in a tubular shape. A first speaker (hereinafter referred to as a right speaker) 28 for a right channel of a pair of the first speaker and a second speaker 28 and 29 is contained in the inside of the enclosure right rotational part 22 in a manner that only a front surface of a circular diaphragm is exposed from an aperture of the right edge part 22A. Here, the enclosure right opening/closing part 24 is configured to be able to be opened or closed independently of the enclosure left opening/closing part 25. Then, the enclosure right opening/closing part 24 can hide the diaphragm of the right speaker 28 from the outside when the enclosure right opening/closing part 24 is rotated via the hinge part 26 and closed by making the aperture edge part 24A in contact with the right edge part 22A of the enclosure right rotational part 22. In addition, the enclosure right opening/closing part 24 is configured to expose the diaphragm of the right speaker 28 to the outside when the enclosure right opening/closing part 24 is rotated via the hinge part 26 and opened in a manner as separating the aperture edge part 24A from the right edge part 22A of the enclosure right rotational part 22.

On the other hand, the enclosure left rotational part 23 is also formed in a tubular shape. A second speaker (hereinafter referred to as a left speaker) 29 for a left channel having a structure and a shape similar to those of the right speaker 28 is contained in the inside of the enclosure left rotational part 23 in a manner that only a front surface of a circular diaphragm is exposed from an aperture of the left edge part 23A. Therefore, the enclosure left opening/closing part 25 can hide the diaphragm of the left speaker 29 from the outside when the enclosure left opening/closing part 25 is rotated via the hinge part 27 and closed by making the aperture edge part 25A in contact with the left edge part 23A of the enclosure left rotational part 23. In addition, the enclosure left opening/closing part 25 is configured to expose the front surface of the diaphragm of the left speaker 29 to the outside when the enclosure left opening/closing part 25 is rotated via the hinge part 27 and opened in a manner as separating the aperture edge part 25A from the left edge part 23A of the enclosure left rotational part 23.

Figure 6:
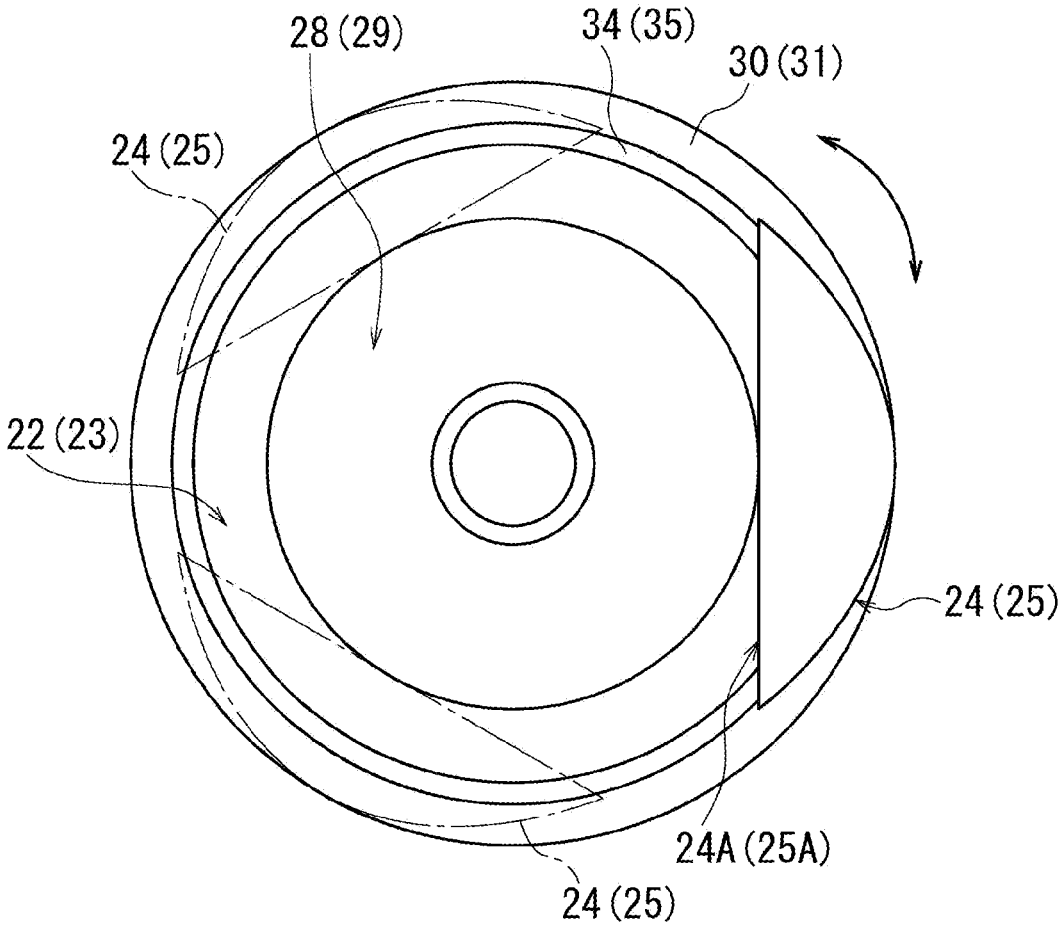
FIG. 6 is a schematic diagram used for explaining a state of rotation of an enclosure right rotatable unit and an enclosure left rotatable unit.

In addition, as shown in FIG. 6, the enclosure right rotational part 22 is configured to be rotatable independently of the enclosure left rotational part 23. Then, the enclosure right rotational part 22 is configured to be rotatable also independently of an opening/closing operation of the enclosure right opening/closing part 24. In addition, the enclosure left rotational part 23 is also configured to be rotatable independently of an opening/closing operation of the enclosure left opening/closing part 25.

In addition to the above, as shown in FIGS. 3A, 3B, and 4, a right wheel 30 having an annular shape with a predetermined external diameter larger than a maximum external diameter of the enclosure center part 21 is held on the right edge part of the enclosure center part 21 in a manner rotatable in one axial direction D1 and the other axial direction centering on the horizontal rotational axis line L1. In addition, a left wheel 31 having a shape and an external shape similar to the right wheel 30 is held on the left edge part of the enclosure center part 21 in a manner rotatable in one axial direction D1 and the other axial direction centering on the horizontal rotational axis line L1. The right wheel 30 rotates together with the left wheel 31 so that the ellipsoid enclosure 20 runs itself. The right wheel 30 is configured to be rotatable independently of the left wheel 31.

Then, in the enclosure center part 21, a weight 32 including a battery and so on is fixed on a predetermined position on an inner wall. In addition, in the enclosure center part 21, a distance between the center point P1 and the right edge part (that is, the right wheel 30) of the ellipsoid enclosure 20 and a distance between the center point P1 and the left edge part (that is, the left wheel 31) of the ellipsoid enclosure 20 are selected to be a substantially equal predetermined distance. Further, the enclosure right rotational part 22 and the enclosure left rotational part 23 are selected to have the same shape, and have a predetermined width substantially equal to each other. Further, the enclosure right opening/closing part 24 and the enclosure left opening/closing part 25 are selected to have the same shape and have a substantially equal predetermined length for widths between the aperture edge parts 24A and 25A and the vertexes P2 and P3 on the surface thereof, respectively. That is, the ellipsoid enclosure 20 has the left and the right parts thereof formed in plane symmetry with respect to a virtual plane (not shown) that passes the center P1 of the ellipsoid enclosure 20 and has the horizontal rotational axis line L1 as a perpendicular.

For the above reason, when the ellipsoid enclosure 20 is placed on a top plate of a desk, floor, and so on (hereinafter collectively referred to as a floor), the ellipsoid 20 is held by the right wheel 30 and the left wheel 31 in an attitude that an outer peripheral surface of a maximum outer shape part of the enclosure center part 21 is little bit separated from a surface of the floor, and the horizontal rotational axis line L1 is in parallel with the surface of the floor. In addition to the above, since the center of gravity of the enclosure center part 21 is shifted from the center point P1 to a position somewhat closer to the inner wall due to the weight 32 in the enclosure center part 21, when the ellipsoid enclosure 20 is placed on the floor, the ellipsoid enclosure 20 has an attitude (hereinafter referred to as a normal attitude) where the weight 32 is positioned on a lower side vertically (that is, the center of gravity created by the weight 32 part is made closer to the surface of the floor). The weight 32 in the enclosure center part 21 is selected to have comparatively heavy weight. Therefore, when the ellipsoid enclosure 20 is placed on the floor in a state of being supported by the right wheel 30 and the left wheel 31, even if each of the enclosure right opening/closing part 24 and the enclosure left opening/closing part 25 is opened in an optional angle independently, and each of the enclosure right rotational part 22 and the enclosure left rotational part 23 rotates independently in a state where each of the enclosure right opening/closing part 24 and the enclosure left opening/closing part 25 is opened independently, the ellipsoid enclosure 20 can maintain the normal attitude without tilting to the right and the left sides and so on.

In addition, when the ellipsoid enclosure 20 runs itself on the floor by a rotation of the right wheel 30 and the left wheel 31, the enclosure center part 21 configures to be restricted to rotate in the one axial direction D1 and the other axial direction centering on the horizontal rotational axis line L1 since the center of gravity of the enclosure center part 21 is shifted from the center point P1 to a position somewhat closer to the inner wall by the weight 32 in the enclosure center part 21. Further, since the weight 32 is comparatively heavy, the ellipsoid enclosure 20 can almost maintain the normal attitude without tilting too much to the right and the left sides, and so on, even if each of the enclosure right opening/closing part 24 and the enclosure left opening/closing part 25 is opened in an optional angle independently when the ellipsoid enclosure 20 runs itself, and each of the enclosure right rotational part 22 and the enclosure left rotational part 23 rotates independently in a state where each of the enclosure right opening/closing part 24 and the enclosure left opening/closing part 25 is opened independently.

In addition to the above, a contact detection sensor unit 33 that detects contact of a finger, a hand, and so on is provided at a position which becomes a top side in the normal attitude on the surface of the enclosure center part 21. The contact detection sensor unit 33 is configured to detect, for example, a finger, a hand, and so on in contact with a fingertip-sized area on the surface of the enclosure center part 21. In addition, a right light emitting part 34 having a ring shape that emits light is provided on the right side of the right wheel 30. Further, a left light emitting part 35 having a ring shape that emits light and has a similar configuration as the right light emitting part 34 is also provided on the left side of the left wheel 31. Each of the right light emitting part 34 and the left light emitting part 35 is configured to emit light by varying a light emitting state in terms of entire light, part of light, color of light, and so on.

(2-2) Configuration of Personal Computer

Figure 7:
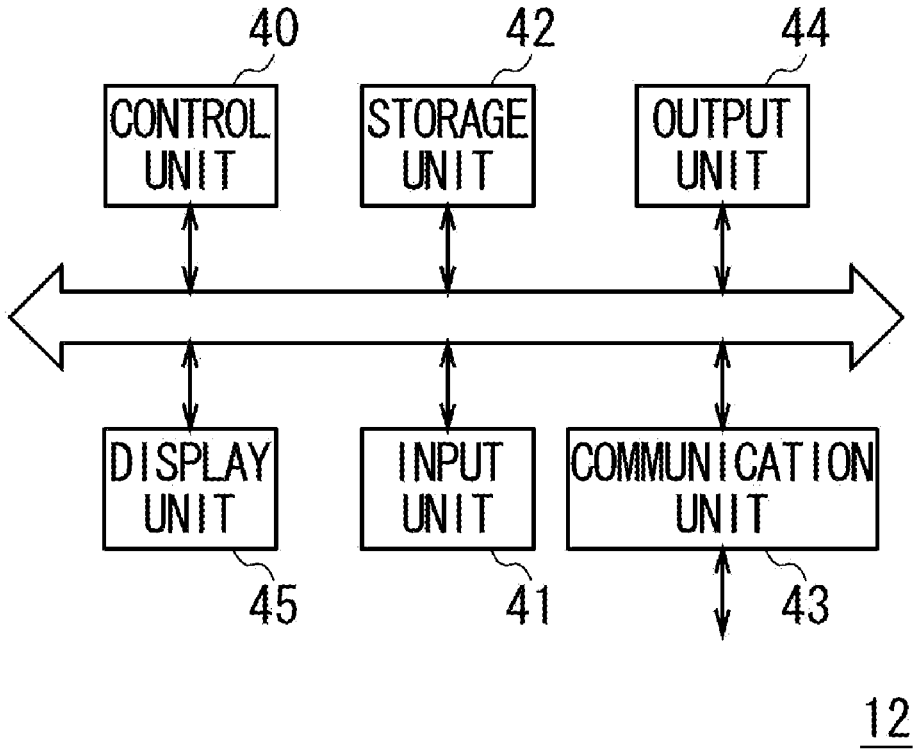
FIG. 7 is a block diagram showing a circuit configuration of a personal computer.

Next, a configuration of a personal computer 12 will be explained by using FIG. 7. In the personal computer 12, when, for example, a variety of commands are input in accordance with user operation in an input unit 41 including a keyboard, a mouse, and so on, a control unit 40 of a microcomputer configuration reads out a variety of programs such as a basic program and an application program stored in a storage unit 42 including an internal memory (not shown) or a hard disk drive in advance. Then, the control unit 40 controls the entire computer in accordance with the variety of programs, and also executes predetermined arithmetic processing and a variety of types of processing corresponding to a variety of commands input via the input unit 41.

In the above manner, when an operation command for recording music data MD1 recorded in media such as a Compact disc (CD) is input via the input unit 41 by a user, the control unit 40 reads out the music data MD1 from the media mounted in the personal computer 12 and also sends out and stores in the storage unit 42 the read-out music data MD1. In addition, when an operation command for requesting distribution of desired music data MD1 is input to the control unit 40 via the input unit 41 by the user, the control unit 40 requests downloading of the desired music data MD1 by accessing a music providing server (not shown) on a network via a communication unit 43 in accordance with the operation command. As a result, when the control unit 40 receives the music data MD1 returned from the music providing server via the communication unit 43, the control unit 40 sends out and stores in the storage unit 42 the music data MD1. In this manner, the control unit 40 is configured to store a number of pieces of music data MD1 in the storage unit 42.

Then, when the music data MD1 in the storage unit 42 is designated by the user via the input unit 41 and an operation command that requests reproducing of the designated music data MD1 is input, the control unit 40 reads out the designated music data MD1 from the storage unit 42 in accordance with the operation command. In addition, the control unit 40 applies predetermined reproducing processing on the music data MD1 read out from the storage unit 42, and then sends out to an output unit 44 including an amplifier, a speaker, and so on. In this manner, the control unit 40 can output music based on the music data MD1 stored in the storage unit 42 from the output unit 44 to make the user capable of listening to the music. Further, when a operation command for reproducing the music data MD1 from media is input by the user via the input unit 41, the control unit 40 reads out the music data MD1 from the media mounted in the personal computer 12 and sends out the music data MD1 to the output unit 44. In this manner, the control unit 40 can also output the music based on the music data MD1 recorded in the media from the output unit 44 to make the user capable of listening to the music.

Further, when the music data MD1 in the storage unit 42 is designated by the user via the input unit 41 and a transfer request to transfer the designated music data MD1 to a music robot device 11 is input, the control unit 40 reads out the designated music data MD1 from the storage unit 42 in accordance with the transfer request and can also transfer the designated music data MD1 to the music robot device 11 via the communication unit 43.

Further, the control unit 40 generates data to be displayed corresponding to an execution result (for example, acquisition of the music data MD1, recording and reproducing, and so on) of a variety of programs and sends out the data to be displayed to a display unit 45 that includes a display control unit and a display. In this manner, the control unit 40 can display a variety of screens that relate to the acquisition, recording, reproducing, and so on of the music data MD1 based on the data to be displayed on the display unit 45 and can make the user capable of visually identify the execution result.

In addition to the above configuration, the control unit 40 stores in the storage unit 42 motion pattern data for moving each of the enclosure right rotational unit 22, the enclosure left rotational unit 23, the enclosure right opening/closing unit 24, the enclosure left opening/closing unit 25, the right wheel 30, and the left wheel 31 as movable parts provided in the music robot device 11 in a predetermined motion pattern for predetermined time (hereinafter referred to as the motion performing time) of several seconds selected in advance. Then, a plurality of types of the motion pattern data are prepared for each of the enclosure right rotational unit 22, the enclosure left rotational unit 23, the enclosure right opening/closing unit 24, the enclosure left opening/closing unit 25, the right wheel 30, and the left wheel 31.

In the above case, the plurality of types of the motion pattern data corresponding to the enclosure right rotational part 22 and the enclosure left rotational part 23 are generated to indicate a rotational direction, a rotational angle, a rotational speed, the number of reverses of the rotational direction, and so on of the enclosure right rotational part 22 and the enclosure left rotational part 23 from when a motion is started corresponding to one motion pattern in each motion performing time to when the motion is finished. Then, as the motion pattern corresponding to the enclosure right rotational part 22 and the enclosure left rotational part 23, there are the motion pattern of moving so as to rotate in one direction with a comparatively slow speed, the motion pattern of moving so as to rotate in one direction with a comparatively fast speed, the motion pattern of moving so as to reverse the rotational direction many times rapidly, and so on, for example.

In addition, the plurality of types of the motion pattern data corresponding to the enclosure right opening/closing part 24 and the enclosure left opening/closing part 25 are generated to indicate an opening/closing direction, an opening/closing angle, an opening/closing speed, the number of opening/closing, and so on of the enclosure right opening/closing part 24 and the enclosure left opening/closing part 25 from when a motion is started corresponding to one motion pattern in each motion performing time to when the motion is finished. Then, as the motion pattern corresponding to the enclosure right opening/closing part 24 and the enclosure left opening/closing part 25, there are the motion pattern of moving so as to open or close with a comparatively slow speed, the motion pattern of moving so as to open or close with a comparatively fast speed, the motion pattern of moving so as to reverse the open/close direction many times rapidly, and so on, for example.

Further, the plurality of types of the motion pattern data corresponding to the right wheel 30 and the left wheel 31 are generated to indicate a rotational direction, a rotational angle, a rotational speed, the number of rotations, and so on of the right wheel 30 and the left wheel 31 from when a motion is started corresponding to one motion pattern in each motion performing time to when the motion is finished. Then, as the motion pattern corresponding to the right wheel 30 and the left wheel 31, there are the motion pattern of moving so as to rotate in one direction with a comparatively slow speed, the motion pattern of moving so as to rotate in one direction with a comparatively fast speed, the motion pattern of moving so as to reverse the rotational direction many times rapidly, and so on, for example.

Then, the plurality of types of the motion pattern data of each of the enclosure right rotational unit 22, the enclosure left rotational unit 23, the enclosure right opening/closing unit 24, the enclosure left opening/closing unit 25, the right wheel 30, and the left wheel 31 (hereinafter also referred to as movable parts of six axes) are organized in a database as attribute information associated with a variety of characteristics of the music and stored in the storage unit 42 so that the motion as the entire music robot device 11 corresponding to the motion pattern of each of the movable parts of six axes matches with the characteristic of the music. Two types of the databases are prepared in accordance with two types of the motion performing time. As shown in FIG. 8, in one of the databases, a plurality of pieces of the motion pattern data (hereinafter referred to as a first motion pattern data) AD corresponding to the motion pattern of the motion performing time of several seconds or so are associated with the characteristics of the music with respect to the movable parts of six axes (hereinafter, the database is referred to as a first motion pattern database ADB). As shown in FIG. 9, in the other database, a plurality of pieces of the motion pattern data (hereinafter referred to as a second motion pattern data) BD corresponding to the motion pattern of the motion performing time (for example, the motion performing time twice as long as the first motion pattern data AD) longer than the first motion pattern data AD are associated with the characteristics of the music with respect to the movable parts of six axes (hereinafter, the database is referred to as a second motion pattern database BDB). In addition, in the first motion pattern database ADB and the second motion pattern database BDB, the first motion pattern data AD and the second motion pattern data BD are associated with identifiers (not shown) intrinsic to the first motion pattern data AD and the second motion pattern data BD. Then, the first motion pattern database ADB and the second motion pattern database BDB are configured such that, one piece of each of the first motion pattern data AD and the second motion pattern data BD can be selected for each of the movable parts of six axes from a plurality of pieces of the first motion pattern data AD and the second motion pattern data BD prepared for each of the movable parts of six axes, in accordance with the characteristics of the music.

(3) Generation of Motion Data in Personal Computer

Here, description will be given with respect to processing of generating motion data UD1 for moving the entire music robot device 11 in accordance with the music based on the music data MD1. As the processing of generating the motion data UD1, there are first interval dividing processing for dividing the music data MD1 into intervals (hereinafter referred to as a beat interval) corresponding to a beat of the music based on the music data MD1, first characteristic detection processing for detecting a characteristic of the music data MD1, and first data allocation processing for allocating the motion pattern data to the intervals of the music data MD1. The control unit 40 of the personal computer 12 is configured to carry out the first interval dividing processing, the first characteristic detection processing, and the first data allocation processing in parallel, and generate the motion data UD1. Hereinafter, the first interval dividing processing, the first characteristic detection processing, and the first data allocation processing will be described in this order.

(3-1) First Interval Dividing Processing

First, the first interval dividing processing by the control unit 40 of the personal computer 12 will be described. When, for example, the music data MD1 is optionally designated via the input unit 41 corresponding to operation on a Graphical User Interface (GUI) (not shown) displayed on the display unit 45 and a command (hereinafter referred to as a motion data generation command) for generating the motion data UD1 for moving the entire music robot device 11 in accordance with the music based on the selected music data MD1 is input by the user, the control unit 40 starts the first interval dividing processing. In the first interval dividing processing, the control unit 40 reads out the designated music data MD1 from the storage unit 42. Then, the control unit 40 analyzes the music data MD1 and divides the music data MD1 into predetermined first unit processing sections (for example, sections equivalent to several tens of milliseconds of the music) along a time axis, and also carries out, for example, conversion by Fast Fourier Transform (FFT) operation for the first unit processing sections. In this manner, the control unit 40 extracts energy for each predetermined frequency band. Then, the control unit 40 calculates the sum of the energy of each frequency band of the first unit processing sections being extracted. As a result, when the sum of the energy of each frequency band of the first processing unit sections is obtained for the entire music data MD1, the control unit 40 detects the beat of the music when the music based on the music data MD1 is reproduced, based on the sum of the energy of each frequency band of the first processing unit sections (for example, by carrying out differential processing the sum of the energy of each frequency band of the first processing unit sections by time for the entire music data MD1).

At the first interval dividing processing, the control unit 40 divides the music data MD1 into the beat intervals (hereinafter referred to as bar intervals) including a beat equivalent to, for example, a one-half bar, one bar, or two bars, when the music based on the music data MD1 is expressed in a music score, in accordance with the detected beat. As the bar intervals, there are first bar intervals MS1 (for example, the bar intervals of four beats as a whole formed in such a manner that three beats are included between beats as section position) formed in such a manner that the predetermined number of beats are included between the beats as section position between the bar intervals, and second bar intervals MS2 (for example, the bar intervals of eight beats as a whole formed in such a manner that seven beats are included between beats as section position) formed in such a manner that the predetermined number of beats that is larger than the number of beats of the first bar intervals MS1 are included between the beats as section position between the intervals. Then, at the first interval dividing processing, the control unit 40 sequentially divides the music data MD1 to any of the first bar intervals MS1 or the second bar intervals MS2, and terminates the first interval dividing processing when the intervals are divided up to the end of the music data MD1.

By the first interval dividing processing described above, the control unit 40 is configured to sequentially divide the entire music data MD1 into the first bar intervals MS1 and the second bar intervals MS2.

In the above case, since the control unit 40 divides the music data MD1 into the first bar intervals MS1 and the second bar intervals MS2 having different interval length in accordance with the beat of the music, the control unit 40 allocates the first motion pattern data AD and the second motion pattern data to the first bar intervals MS1 and the second bar intervals MS2 being divided to finally generate the motion data UD1. When the music robot device 11 is controlled to play the motion data UD1 together with the music data MD1, the control unit 40 can make the music robot device 11 capable of moving in a variety of ways as compared with the case where there is only one type of the bar intervals.

In addition, in the above case, in a case where a cycle of change of the melody of the music based on the music data MD1 is longer than the first bar intervals MS1 of the music data MD1, the control unit 40 allocates the second motion pattern data BD by dividing the music data MD1 by the second bar intervals MS2 having a longer interval than the first bar intervals MS1. In this manner, when the control unit 40 finally generates the motion data UD1 and controls the music robot device 11 to reproduce the motion data UD1 together with the music data MD1, for example, in a case where a soft melody continues for a long time at the beginning of the music based on the music data MD1, the control unit 40 can control the music robot device 11 to be operated in the motion pattern in synchronization with the melody of the music, not to frequently change the motion pattern and make the user feel uncomfortable. Further, in a case where a cycle of change of the melody of the music based on the music data MD1 is shorter than the second bar intervals MS2 of the music data MD1, the control unit 40 allocates the first motion pattern data AD by dividing the music data MD1 by the first bar intervals MS1 having a shorter interval than the second bar intervals MS2. In this way, when the control unit 40 finally generates the motion data UD1, and controls the music robot device 11 to reproduce the motion data UD1 together with the music data MD1, for example, in a case where the melody frequently changes in accordance with a fast tempo of the music, the control unit 40 can control the music robot device 11 to operate in the same motion pattern despite the change of the melody of the music so that the music robot device 11 can be operated in the motion pattern in synchronization with the melody of the music without causing the user to feel uncomfortable.

(3-2) First Characteristic Detection Processing

Next, the first characteristic detection processing carried out by the control unit 40 of the personal computer 12 will be described. The control unit 40 starts the first characteristic detection processing when the motion data generation command is input. In the first characteristic detection processing, when the control unit 40 reads out the designated music data MD1 from the storage unit 42, the control unit 40 divides the music data MD1 into predetermined second unit processing sections (for example, sections equivalent to one second of the music) along the time axis of the music, and also extracts the energy of each frequency band equivalent to twelve scales of one octave from the second unit processing sections. As a result, when the control unit 40 extracts the energy of each frequency band for the entire music data MD1, the control unit 40 detects a variety of pieces of information such as a musical instrument used in musical performance of the music, a chord based on a harmony of the music, a phrase of the music, and so on, based on the energy of each frequency band, also detects the characteristic of the music, and then generates characteristic digitization information that expresses the detection result converted into numbers. Then, at the first characteristic detection processing, the control unit 40 sequentially generates the characteristic digitization information from the beginning of the music data MD1, and terminates the first characteristic detection processing when the characteristic digitization information is generated up to the end of the music data MD1.

Note that a position of the beat, a tempo, a volume, a chord (chord progression), a phrase, a melody, and so on of music are collectively designated as a characteristic of the music hereinafter.

By the first characteristic detection processing described above, the control unit 40 is configured to obtain the characteristic digitization information for the entire music data MD1. In addition, the control unit 40 carries out the first interval dividing processing and the first characteristic detection processing in parallel, thereby the characteristic digitization information can be obtained for each of the first bar intervals MS1 and the second bar intervals MS2 of the music data MD1.

(3-3) First Data Allocation Processing

Further, the first data allocation processing carried out by the control unit 40 of the personal computer 12 will be described. When the motion data generation command is input, the control unit 40 starts the first data allocation processing. Then, the control unit 40 sequentially allocates the first motion pattern data AD and the second motion pattern data BD stored in the storage unit 42 to the first bar intervals MS1 and the second bar intervals MS2 of the music data MD1 divided by the first interval dividing processing described above. Hereinafter, detailed description will be made with respect to a method of allocating the first motion pattern data AD and the second motion pattern data BD stored in the storage unit 42 to the first bar intervals MS1 and the second bar intervals MS2 of the music data MD1.

At the first data allocation processing, the control unit 40 randomly reads out to the first bar intervals MS1 of the music data MD1 one piece of the first motion pattern data AD for each of the movable parts of six axes from a plurality of pieces of the first motion pattern data AD prepared for each of the movable parts of six axes of the first pattern database ADB stored in the storage unit 42 that are associated with characteristics of a part of the music corresponding to the characteristic digitization information of the first bar intervals MS1 of the music data MD1 in accordance with the characteristics (FIG. 8). That is, in a case where the characteristic digitization information of the first bar intervals MS1 of the music data MD1 indicates, for example, that the tempo of the part of the music based on the first bar intervals MS1 of the music data MD1 is fast, the control unit 40 randomly reads out one piece of the first motion pattern data AD to each of the movable parts of six axes from a plurality of pieces of the first motion pattern data AD prepared for each of the movable parts of six axes associated with the characteristic for a fast tempo in the first motion pattern database ADB. On the other hand, in a case where the characteristic digitization information of the first bar intervals MS1 of the music data MD1 indicates, for example, that the tempo of the part of the music based on the first bar intervals MS1 of the music data MD1 is slow, the control unit 40 randomly reads out one piece of the first motion pattern data AD to each of the movable parts of six axes from a plurality of pieces of the first motion pattern data AD prepared for each of the movable parts of six axes associated with the characteristic for a slow tempo in the first motion pattern database ADB.

On the other hand, at the first data allocation processing, the control unit 40 randomly reads out to the second bar intervals MS2 of the music data MD1 one piece of the second motion pattern data BD for each of the movable parts of six axes from a plurality of pieces of the second motion pattern data BD prepared for each of the movable parts of six axes of the second pattern database BDB stored in the storage unit 42 that are associated with characteristics of a part of the music corresponding to the characteristic digitization information of the second bar intervals MS2 of the music data MD1 in accordance with the characteristics (FIG. 9). That is, in a case where the characteristic digitization information of the second bar intervals MS2 of the music data MD1 indicates, for example, that the tempo of the part of the music based on the second bar intervals MS2 of the music data MD1 is fast, the control unit 40 randomly reads out one piece of the second motion pattern data BD to each of the movable parts of six axes from a plurality of pieces of the second motion pattern data BD prepared for each of the movable parts of six axes associated with the characteristic for a fast tempo in the second motion pattern database BDB. On the other hand, in a case where the characteristic digitization information of the second bar intervals MS2 of the music data MD1 indicates, for example, that the tempo of the part of the music based on the second bar intervals MS2 of the music data MD1 is slow, the control unit 40 randomly reads out one piece of the second motion pattern data BD to each of the movable parts of six axes from a plurality of pieces of the second motion pattern data BD prepared for each of the movable parts of six axes associated with the characteristic for a slow tempo in the second motion pattern database BDB.

In the above manner, at the time of the first data allocation processing, the control unit 40 reads out the first motion pattern data AD and the second motion pattern data BD of each of the movable parts of six axes in accordance with the characteristic of the part of the music corresponding to the first bar intervals MS1 and the second bar intervals MS2 of the music data MD1 from the first motion pattern database ADB and the second motion pattern database BDB. Therefore, when the control unit 40 finally generates the motion data UD1 in accordance with the first motion pattern data AD and the second motion pattern data BD read out in the above manner in accordance with the characteristic of the part of the music, and controls the music robot device 11 to reproduce the motion data UD1 together with the music data MD1, the control unit 40 can control the music robot device 11 to move in accordance with an image and atmosphere of the music based on the music data MD1.

In addition, in the above case, since the control unit 40 randomly reads out one piece of the first motion pattern data AD and the second motion pattern data BD with respect to each of the movable parts of six axes from a plurality of the first motion pattern data AD and the second motion pattern data BD prepared for each of the movable parts of six axes, the control unit 40 can read out the first motion pattern data AD and the second motion pattern data BD in combinations of a variety of motion patterns as the motion of the movable parts of six axes even in a case where the characteristic of the music of the first bar intervals MS1 and that of the second bar intervals MS2 are the same (that is, the tempo of the music is fast or slow). Therefore, when the control unit 40 finally generates the motion data UD1 in accordance with the first motion pattern data AD and the second motion pattern data BD being read out and controls the music robot device 11 to reproduce the motion data UD1 together with the music data MD1, the control unit 40 can control the music robot device 11 to move in a variety of ways for the number of combinations of the motion patterns.

Further, in the above case, the control unit 40 reads out the first motion pattern data AD and the second motion pattern data BD that has the motion performing time different from the first motion pattern data AD to the first bar intervals MS1 and the second bar intervals MS2 of the music data MD1. Therefore, when the control unit 40 finally generates the motion data UD1 in accordance with the first motion pattern data AD and the second motion pattern data BD read out in the above manner, and controls the music robot device 11 to reproduce the motion data UD1 together with the music data MD1, the control unit 40 can control the music robot device 11 to move in a variety of ways better than a case where there is only the motion pattern data based on the motion pattern of one type of the motion performing time.

Further, in the above case, although the control unit 40 identifies a plurality of pieces of the first motion pattern data AD and the second motion pattern data BD prepared for each of the movable parts of six axes corresponding to the characteristic of the music in the first motion pattern database ADB and the second motion pattern database BDB, the control unit 40 randomly reads out one piece of the first motion pattern data AD and the second motion pattern data BD to each of the movable parts of six axes from a plurality of pieces of the first motion pattern data AD and the second motion pattern data BD prepared for each of the identified movable part of six axes. In this manner, load of processing in relation to the readout of the first motion pattern data AD and the second motion pattern data BD can be reduced as compared with a case where all of a plurality of pieces of the first motion pattern data AD and the second motion pattern data BD prepared for each of the movable parts of six axes are screened and read out.

In addition to the above, at the time of the first data allocation processing, when the control unit 40 reads out the first motion pattern data AD and the second motion pattern data BD of each of the movable parts of six axes corresponding to the characteristic associated with the characteristic digitization information of the first bar intervals MS1 and the second bar intervals MS2 of the music data MD1 from the first motion pattern database ADB and the second motion pattern database BDB, the control unit 40 detects a chord of the music of each of the first bar intervals MS1 and the second bar intervals MS2 of the music data MD1 in accordance with the characteristic digitization information. Then, in association with the chord of the music of each of the first bar intervals MS1 and the second bar intervals MS2 of the music data MD1 divided between a point in time where a motion data generation command is input and a current point in time, the control unit 40 stores in the storage unit 42 identifiers of the first motion pattern data AD and the second motion pattern data BD for each of the movable parts of six axes read out to the first bar intervals MS1 and the second bar intervals MS2 of the music data MD1 divided up to the above point in time, as historic information.

In the above manner, when the control unit 40 detects the chord of the first bar intervals MS1 of the music data MD1 in accordance with the characteristic digitization information (hereinafter, the chord detected in this manner will be referred to as a detected chord), in a case where there is a chord (hereinafter referred to as a stored chord) of the first bar intervals MS1 stored in the storage unit 42 between the point in time where the motion data generation command is input and the current point in time which is same as the detected chord, the control unit 40 reads out the identifier of the first motion pattern data AD for each of the movable parts of six axes associated with the stored chord that is same as the detected chord from the storage unit 42. Then, the control unit 40 reads out the first motion pattern data AD for the associated six axes from the first motion pattern database ADB in accordance with the identifier of the first motion pattern data AD for each of the read-out movable parts of six axes.

In addition, at the first data allocation processing, when the control unit 40 detects the chord of the second bar intervals MS2 (that is, when the control unit 40 detects the detected chord) in accordance with the characteristic digitization information, and in a case where there is the stored chord which is same as the detected chord in the stored chord of the second bar intervals MS2 stored in the storage unit 42 between the point in time where the motion data generation command is input and the current point in time, the control unit 40 reads out the identifier of the second motion pattern data BD corresponding to each of the movable parts of six axes associated with the stored chord which is same as the detected chord from the storage unit 42. Then, the control unit 40 reads out the corresponding second motion pattern data BD of six axes from the second motion pattern database BDB in accordance with the identifier of the second motion pattern data BD with respect to each of the movable part of six axes being read out.

Figure 10:
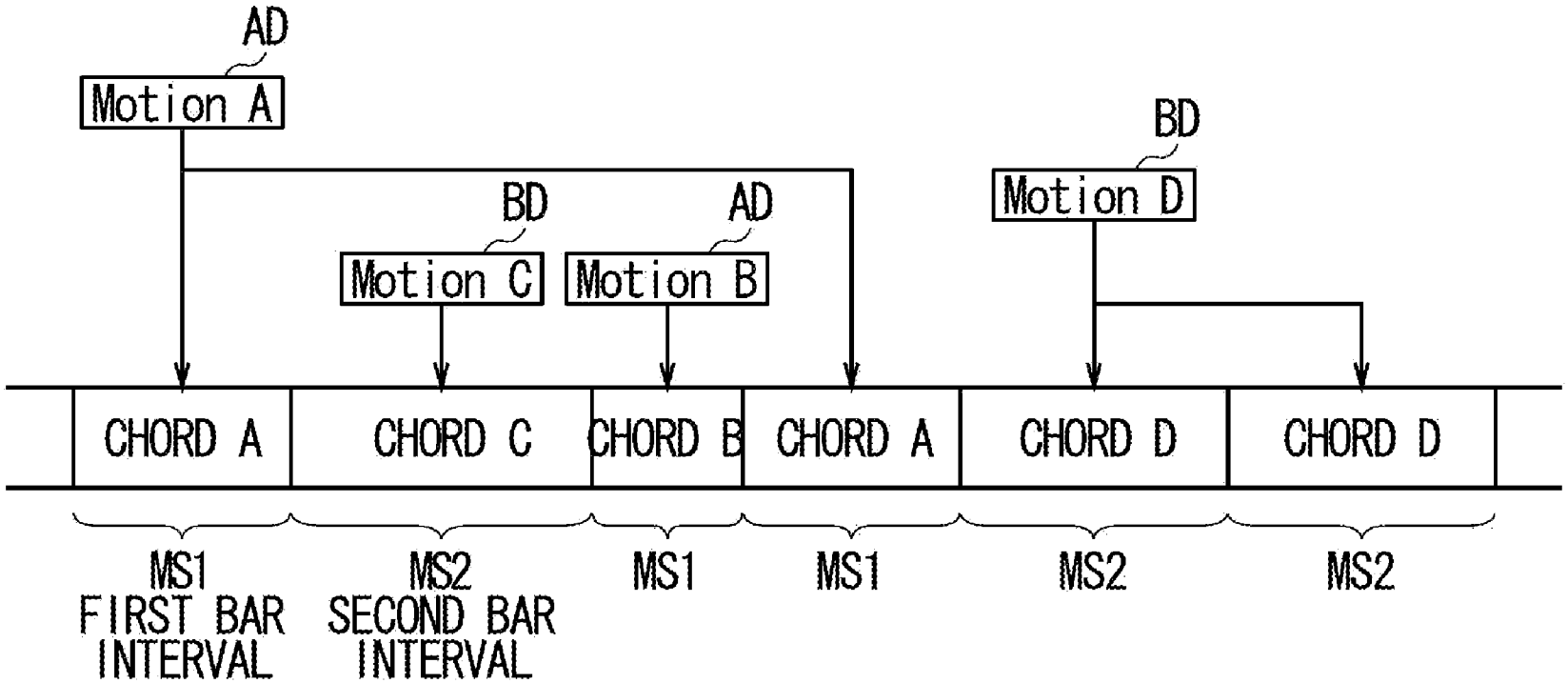
FIG. 10 is a schematic diagram used for explaining a state of reading out of a motion pattern data.

In the above manner, as shown in FIG. 10, at the time of the first data allocation processing, the control unit 40 reads out the same first motion pattern data AD for each of the movable parts of six axes with respect to the first bar intervals MS1 in which the same chord is detected among a plurality of the first bar intervals MS1 of the music data MD1. Also, the control unit 40 reads out the same second motion pattern data BD for each of the movable parts of six axes with respect to the second bar intervals MS2 in which the same chord is detected among a plurality of the second bar intervals MS2 of the music data MD1. That is, when the control unit 40 finally generates the motion data UD1 in accordance with the first motion pattern data AD and the second motion pattern data BD being read out, the control unit 40 can allocate the first motion pattern data AD and the second motion pattern data BD having the same motion pattern to the first bar intervals MS1 and the second bar intervals MS2 having the same chord in the music data MD1. In this manner, when the control unit 40 controls the music robot device 11 to reproduce the motion data UD1 together with the music data MD1, the control unit 40, for example, can control the music robot device 11 to move in the same way at a part formed by the same chord such as a repeated part in the music based on the music data MD1, and can demonstrate the music robot device 11 as though the music robot device 11 moves with intelligence.

Here, the beat of the music is in a relationship where intervals between the beats become narrower when the tempo of the music becomes fast, and the intervals between the beats become wider when the tempo of the music becomes slower. In addition, the first bar intervals MS1 and the second bar intervals MS2 of the music data MD1 are divided depending on the beat of the music. That is, length of the first bar intervals MS1 and the second bar intervals MS2 of the music data MD1 divided by the control unit 40 varies along with a difference in the tempo of the music based on the music data MD1. Therefore, at the first data allocation processing, when the control unit 40 reads out the first motion pattern data AD and the second motion pattern data BD of each of the movable parts of six axes matching with the characteristics of the first bar intervals MS1 and the second bar intervals MS2 of the music data MD1, time during which a part of the music based on the first bar intervals MS1 and the second bar intervals MS2 of the music data MD1 is played, and the motion performing time required for executing the motion pattern based on the first motion pattern data AD and the second motion pattern data BD do not necessarily match with each other.

Figure 11:
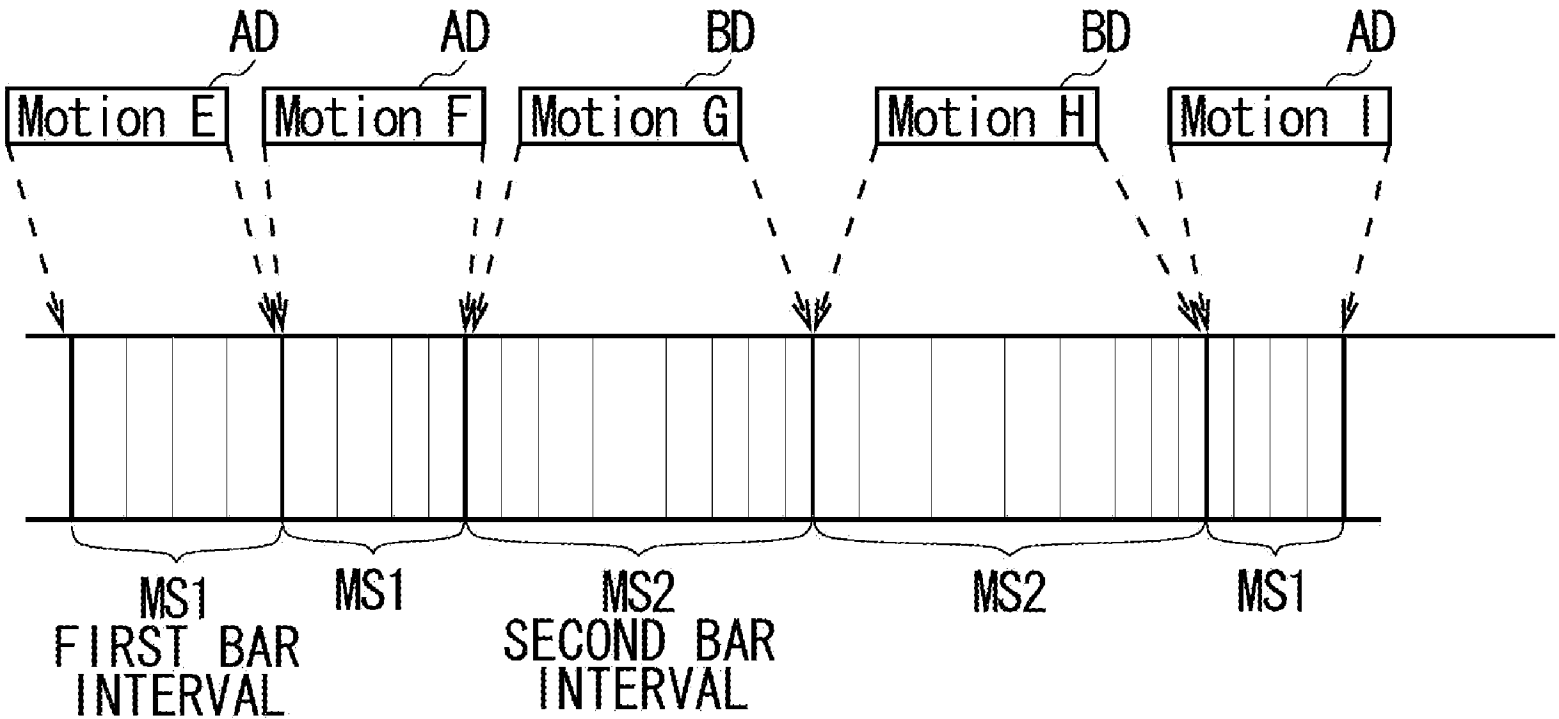
FIG. 11 is a schematic diagram used for explaining a state of allocating the motion pattern data.

In the above manner, as shown in FIG. 11, at the first data allocation processing, when the control unit 40 reads out the first motion pattern data AD of each of the movable parts of six axes corresponding to the first bar intervals MS1 of the music data MD1, the control unit 40 modifies the first motion pattern data AD of each of the movable parts of six axes, in such a manner that the motion performing time of the motion pattern based on the first motion pattern data AD of each of the movable parts of six axes being read out is extended and shortened so that the start and the end of the motion pattern match with the beginning and the end of the interval of the first bar intervals MS1, and also allocates the modified first motion pattern data AD of each of the movable parts of six axes to the first bar intervals MS1. In addition, at the first data allocation processing, when the control unit 40 reads out the second motion pattern data BD of each of the movable parts of six axes corresponding to the second bar intervals MS2 of the music data MD1, the control unit 40 modifies the second motion pattern data BD of each of the movable parts of six axes in such a manner that the motion performing time of the motion pattern based on the second motion pattern data BD of each of the movable parts of six axes being read out is extended and shortened so that the start and the end of the motion pattern match with the beginning and the end of the interval of the second bar intervals MS2, and also allocates the modified second motion pattern data BD of each of the movable parts of six axes to the second bar intervals MS2. Then, at the first data allocation processing, the control unit 40 sequentially modifies and allocates the first motion pattern data AD and the second motion pattern data BD of each of the movable parts of six axes to the first bar intervals MS1 and the second bar intervals MS2 of the music data MD1, and the first data allocation processing is terminated when the control unit 40 allocates the first motion pattern data AD and the second motion pattern data BD of each of the movable parts of six axes up to the first bar intervals MS1 and the second bar intervals MS2 at the end of the music data MD1.

By the first data allocation processing as described above, the control unit 40 reads out and allocates the first motion pattern data AD and the second motion pattern data BD of each of the movable parts of six axes corresponding to the characteristic of the music to the first bar intervals MS1 and the second bar intervals MS2 of the music data MD1. Therefore, when the control unit 40 finally generates the motion data UD1 in accordance with the first motion pattern data AD and the second motion pattern data BD of each of the movable parts of six axes being allocated, and controls the music robot device 11 to reproduce the motion data UD1 together with the music data MD1, the control unit 40 can switch the motion pattern in synchronization with switching of the first bar intervals MS1 and the second bar intervals MS2 corresponding to a bar when the music based on the music data MD1 is expressed in a musical score. In this manner, the control unit 40 can control the music robot device 11 to operate as though the music robot device 11 dances in synchronization with the melody of the music being reproduced.

In addition, at the first data allocation processing, the control unit 40 reads out the first motion pattern data AD and the second motion pattern data BD of each of the movable parts of six axes corresponding to the first bar intervals MS1 and the second bar intervals MS2 of the music data MD1, and allocates by modifying the first motion pattern data AD and the second motion pattern data BD of each of the movable parts of six axes so that the start and the end of the motion pattern based on each of the first motion pattern data AD and the second motion pattern data BD of each of the movable parts of six axes being read out and the beginning and the end of each of the first bar intervals MS1 and the second bar intervals MS2 of the music data MD1 match with each other. Therefore, when the control unit 40 finally generates the motion data UD1 in accordance with the first motion pattern data AD and the second motion pattern data BD of each of the movable parts of six axes being allocated, and controls the music robot device 11 to reproduce the motion data UD1 together with the music data MD1, the control unit 40 can control the music robot device 11 to move continuously in accordance with the melody of the music being reproduced without the motion pattern corresponding to the motion pattern data being unnaturally interrupted at the time when the first bar intervals MS1 and the second bar intervals MS2 corresponding to a bar as the music based on the music data MD1 is expressed in a musical score are switched.

Figure 12:
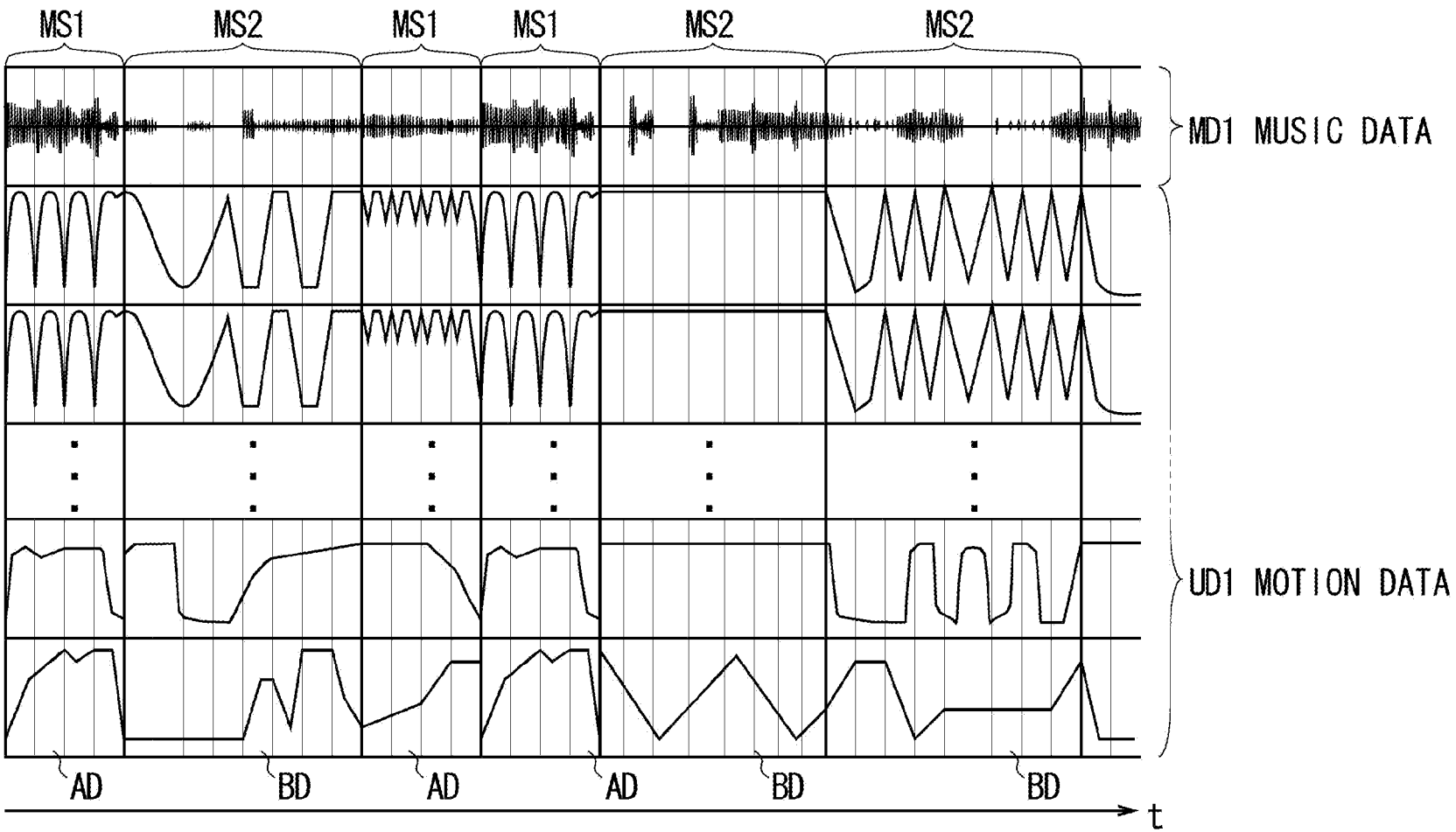
FIG. 12 is a schematic diagram used for explaining a state of generation of motion data.

In the above manner, the control unit 40 of the personal computer 12 carries out the first interval dividing processing, the first characteristic detection processing, and the first data allocation processing described above in parallel, thereby the control unit 40 allocates the first motion pattern data AD and the second motion pattern data BD of each of the movable parts of six axes to the first bar intervals MS1 and the second bar intervals MS2 of the music data MD1 along a reproduction time axis t to generate the motion data UD1, as shown in FIG. 12.

In addition, the control unit 40 repeatedly carries out the first interval dividing processing, the first characteristic detection processing, and the first data allocation processing described above in parallel every time the motion data generation command is input by the user, thereby the control unit 40 newly generates the motion data UD1 again. That is, the control unit 40 can generate the motion data UD1 that is different every time the motion data generation command is input, even with the same music data MD1. Therefore, the control unit 40 controls the music robot device 11 to reproduce the motion data UD1 generated in the above manner together with the music data MD1. In this manner, even with the same music data MD1, the control unit 40 can control the music robot device 11 to move in accordance with a combination of the motion patterns that are different every time the motion data generation command is input, thereby a degree of entertainment can be improved.

Then, the control unit 40 sequentially sends out the motion data UD1 generated in the above manner to the music robot device 11 together with the music data MD1 for each piece of predetermined unit processing data via the communication unit 43, and controls the music robot device 11 to reproduce the motion data UD1 together with the music data MD1, thereby the control unit 40 is configured to control the music robot device 11 to move in synchronization with the melody of the music being reproduced.

Figure 13:
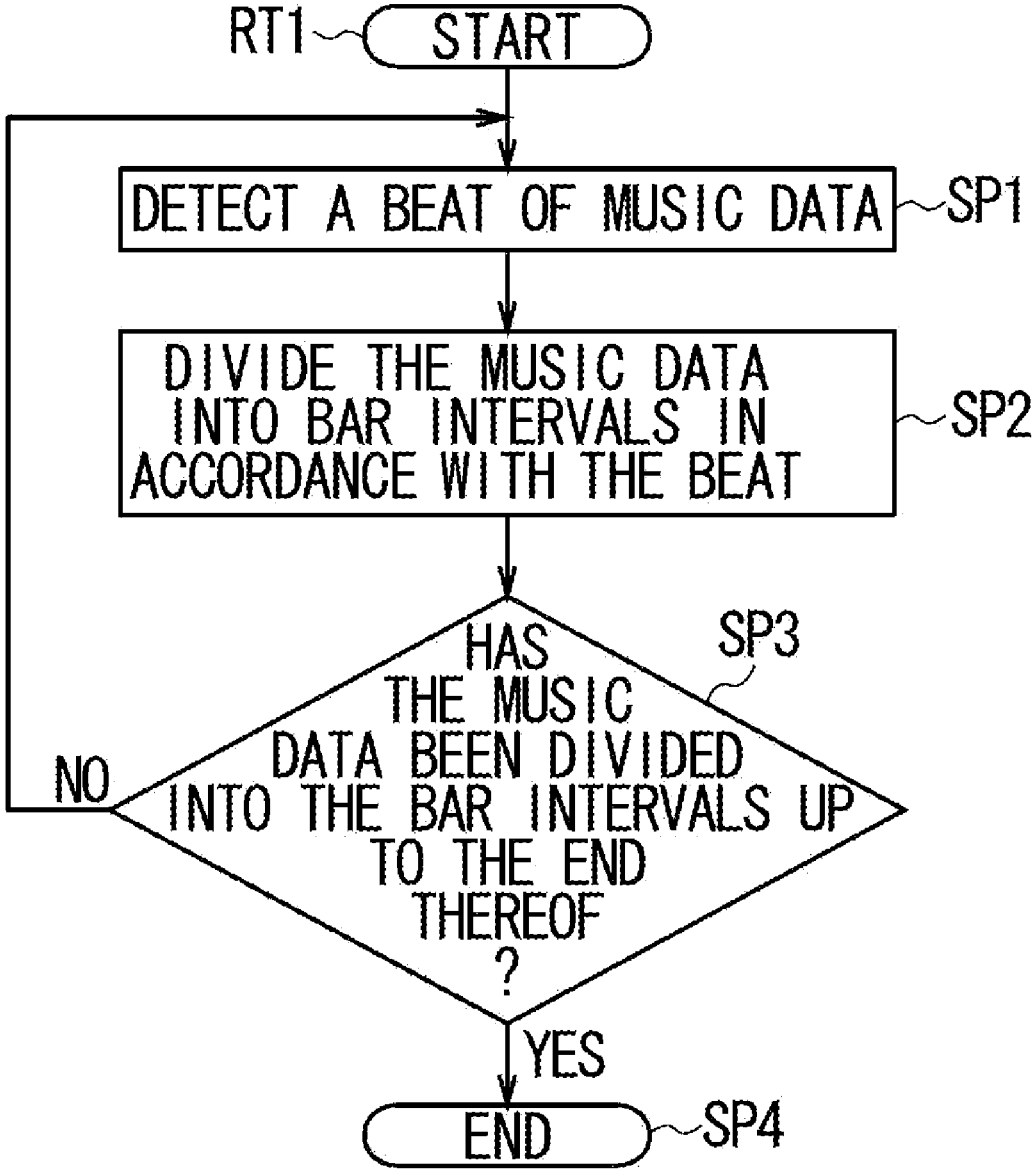
FIG. 13 is a flowchart showing a first interval dividing processing procedure.

(4) Description of Processing Procedures (4-1) First Interval Dividing Processing Procedure Here, a procedure of the first interval dividing processing described above will be described. When the user inputs the motion data generation command, the personal computer 12 starts a first interval dividing processing procedure RT1 as shown in FIG. 13. When the first interval dividing processing procedure RT1 is started, the control unit 40 of the personal computer 12 detects the beat of the music data MD1 read out by the storage unit 42 in Step SP1, and the procedure moves to the next Step SP2.

In Step SP2, the control unit 40 sequentially divides the entire music data MD1 into the first bar intervals MS1 and the second bar intervals MS2 in accordance with the detected beat, and then the procedure moves to the next Step SP3.

In Step SP3, the control unit 40 determines whether or not the music data MD1 has been divided into the first bar intervals MS1 and the second bar intervals MS2 up to the end thereof. If a result is negative in Step SP3, this means that the entire music data MD1 has not been divided into the first bar intervals MS1 and the second bar intervals MS2 yet. Therefore, in this case, the control unit 40 returns to Step SP1, and repeats the procedure from Step SP1 to Step SP3 described above until a positive result is obtained in Step SP3.

On the other hand, if the positive result is obtained in Step SP3, this means that the entire music data MD1 has been divided into the first bar intervals MS1 and the second bar intervals MS2. Therefore, the control unit 40 moves to the next Step SP4 and terminates the first interval dividing processing procedure RT1.

The control unit 40 is configured to divide the entire music data MD1 into the first bar intervals MS1 and the second bar intervals MS2 by the first interval dividing processing procedure RT1 as described above.

(4-2) First Characteristic Detection Procedure Processing

Figure 14:
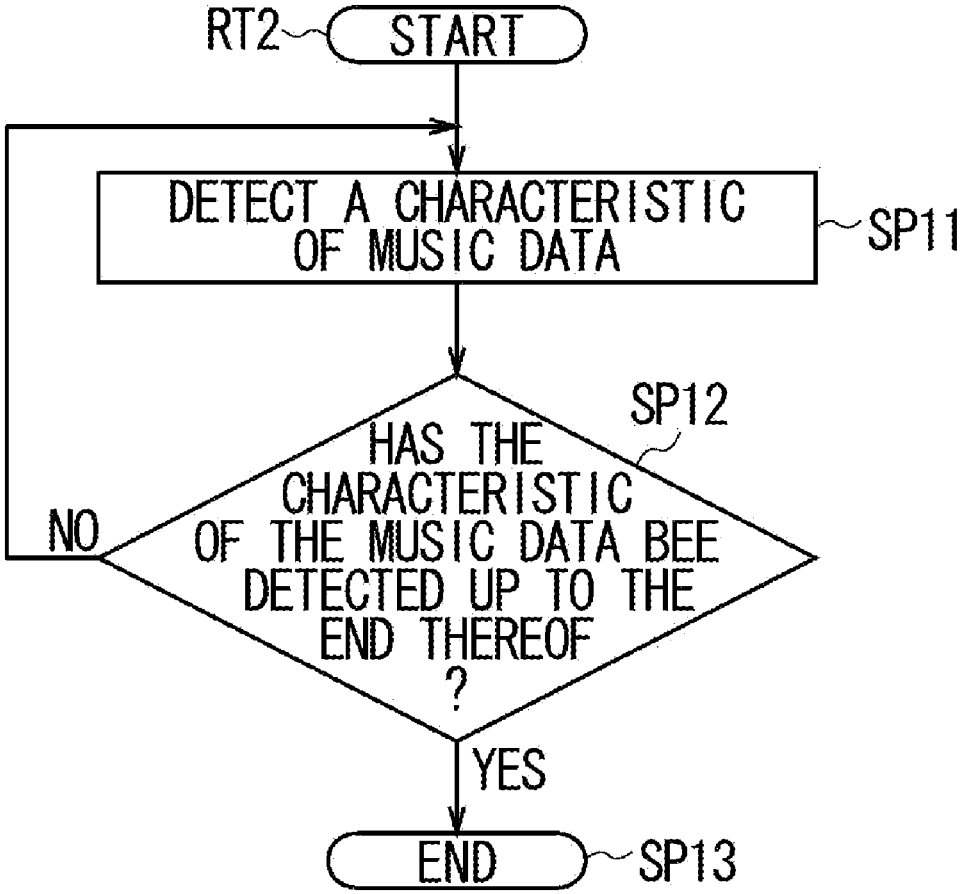
FIG. 14 is a flowchart showing a first characteristic detection processing procedure.

Next, a procedure of the first characteristic detection processing described above will be described. When the user inputs the motion data generation command, the personal computer 12 starts the first characteristic detection processing procedure RT2 as shown in FIG. 14. When the first characteristic detection processing procedure RT2 is started, the control unit 40 of the personal computer 12 detects the characteristic of the music data MD1 read out by the storage unit 42 in Step SP11 to generate the characteristic digitization information, and then the procedure moves to the next Step SP12.

In Step SP12, the control unit 40 determines whether or not the characteristic of the music data MD1 has been detected up to the end thereof. If a result is negative in Step SP12, this means that the characteristic of the entire music data MD1 has not been detected yet. Therefore, in this case, the control unit 40 returns to Step SP11, and repeats the procedure from Step SP11 to Step SP12 described above until a positive result is obtained in Step SP12.

On the other hand, if the positive result is obtained in Step SP12, this means that the characteristic of the entire music data MD1 has been detected. Therefore, the control unit 40 moves to the next Step SP13 and terminates the first characteristic detection processing procedure RT2.

The control unit 40 is configured to detect the characteristic of the music data MD1 to generate the characteristic digitization information by the first characteristic detection processing procedure RT2 as described above.

(4-3) First Data Allocation Processing Procedure

Figure 15:
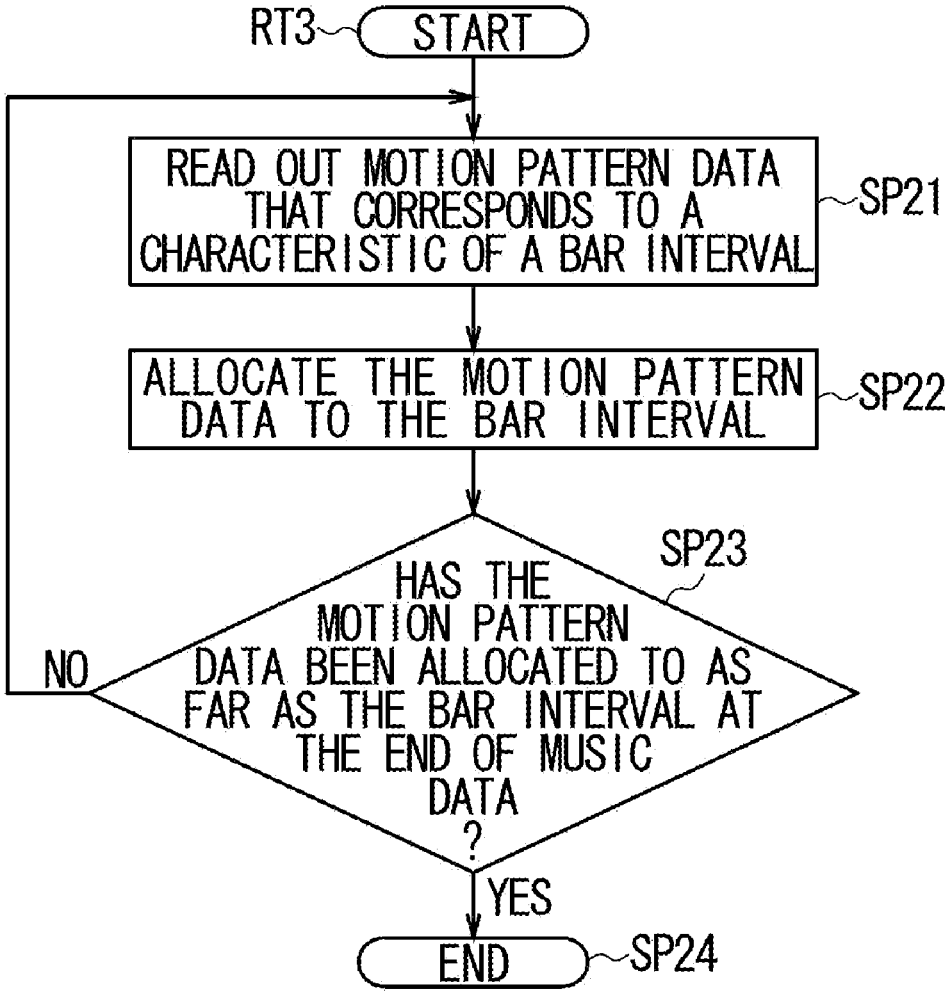
FIG. 15 is a flowchart showing a first data allocation processing procedure.

Further, a procedure of the first data allocation processing described above will be described. When the user inputs the motion data generation command, the personal computer 12 starts the first data allocation processing procedure RT3 as shown in FIG. 15. When the first data allocation processing procedure RT3 is started, the control unit 40 of the personal computer 12 reads out the first motion pattern data AD and the second motion pattern data BD of each of the movable parts of six axes corresponding to the characteristic of the first bar intervals MS1 and the second bar intervals MS2 of the music data MD1 in accordance with the characteristic digitization information of each of the first bar intervals MS1 and the second bar intervals MS2 of the music data MD1 from the first motion pattern database ADB and the second motion pattern database BDB in Step SP21, and then the procedure moves to the next Step SP22.

In Step SP22, the control unit 40 sequentially allocates the first motion pattern data AD and the second motion pattern data BD of each of the movable parts of six axes being read out to the first bar intervals MS1 and the second bar intervals MS2 of the music data MD1, and then moves to the next Step SP23.

In Step SP23, the control unit 40 determines whether or not the first motion pattern data AD and the second motion pattern data BD of each of the movable parts of six axes have been allocated up to the first bar intervals MS1 and the second bar intervals MS2 at the end of the music data MD1. If a result is negative in Step SP23, this means that the first motion pattern data AD and the second motion pattern data BD have not been allocated to the entire music data MD1 yet. Therefore, in this case, the control unit 40 returns to Step SP21, and repeats the procedure from Step SP21 to Step SP23 described above until a positive result is obtained in Step SP23.

On the other hand, if the positive result is obtained in Step SP23, this means that the first motion pattern data AD and the second motion pattern data BD have been allocated to the entire music data MD1. Therefore, the control unit 40 moves to the next Step SP24 and terminates the first data allocation processing procedure RT3.

The control unit 40 is configured to allocate the first motion pattern data AD and the second motion pattern data BD to the entire music data MD1 by the first data allocation processing procedure RT3 as described above.

(5) Circuit Configuration of Music Robot Device

Figure 16:
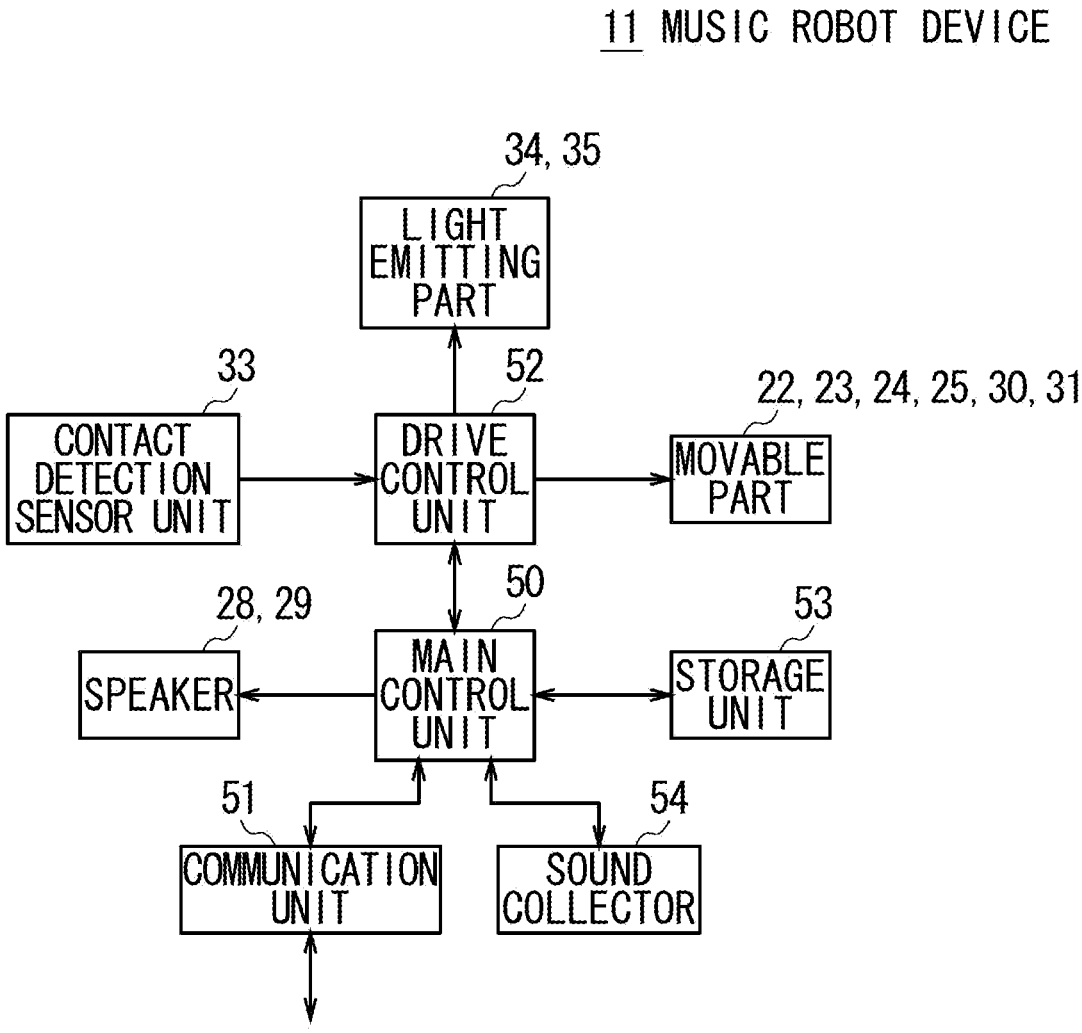
FIG. 16 is a block diagram showing a circuit configuration of the music robot device.

Next, a circuit configuration of the music robot device 11 will be described by using FIG. 16. The music robot device 11 has each circuit thereof contained in the ellipsoid enclosure 20, and a main control unit 50 that controls the entire music robot device 11 as the circuit in an integrated manner. Then, the main control unit 50 executes a variety of types of processing in accordance with a variety of programs such as a control program stored in a storage unit 53 including, for example, a flash memory, in advance. In this manner, when the main control unit 50 receives the music data MD1 for each piece of unit processing data sent out from the personal computer 12 and the motion data UD1 corresponding to the music data MD1 via the communication unit 51, the main control unit 50 starts music reproducing processing that sequentially reproduces the entire music data MD1 and the entire motion data UD1.

When the music reproducing processing is started, the main control unit 50 applies predetermined reproducing processing to the music data MD1 received via the communication part 51 and sends out the music data MD1 to the right speaker 28 and the left speaker 29. In this manner, the main control unit 50 outputs the music based on the music data MD1 from the right speaker 28 and the left speaker 29 to make the user capable of listening to the music.

In addition, at the music reproducing processing, the main control unit 50 sends out the motion data UD1 corresponding to the music data MD1 received via the communication part 51 to a drive control unit 52. When the drive control unit 52 obtains the first motion pattern data AD and the second motion pattern data BD (FIG. 12) of each of the movable parts of six axes in accordance with the motion data UD1, the drive control unit 52 starts drive control of each of the enclosure right rotational unit 22, the enclosure left rotational unit 23, the enclosure right opening/closing unit 24, the enclosure left opening/closing unit 25, the right wheel 30, and the left wheel 31 as movable parts in accordance with the first motion pattern data AD and the second motion pattern data BD of each of the movable parts of six axes so as to synchronize with the start of the output of the music based on the music data MD1 from the right speaker 28 and the left speaker 29.

In the above manner, the drive control unit 52 rotationally drives the enclosure right rotational unit 22 and the enclosure left rotational unit 23 in accordance with the melody of the music based on the music data MD1 being reproduction-processed. In addition, the drive control unit 52 open-/close-drives the enclosure right opening/closing unit 24 and the enclosure left opening/closing unit 25 in accordance with the melody of the music based on the music data MD1 being reproduction-processed. That is, the drive control unit 52 opens and closes the enclosure right opening/closing unit 24 and the enclosure left opening/closing unit 25 while rotating the enclosure right rotational unit 22 and the enclosure left rotational unit 23 so as to synchronize with the melody of the music output from the right speaker 28 and the left speaker 29. Further, the drive control unit 52 rotationally drives the right wheel 30 and the left wheel 31 in accordance with the melody of the music based on the music data MD1 being reproduction-processed. That is, the drive control unit 52 rotates the right wheel 30 and the left wheel 31 so as to synchronize with the melody of the music output from the right speaker 28 and the left speaker 29. Then, the main control unit 50 terminates the output of the music based on the music data MD1 and the drive control of each of the movable parts of six axes in accordance with the end of the send-out of the music data MD1 and the motion data UD1 from the personal computer 12, and then terminates the music reproducing processing. Subsequently, the main control unit 50 notifies the user of the termination of the music reproducing processing by, for example, emitting light in a predetermined light emitting pattern from the right light emitting part 34 and the left light emitting part 35.

In the above manner, at the music reproducing processing, the music robot device 11 can synchronize with the melody of the music being reproduced and operate as though the music robot device 11 itself is dancing.

In addition, when the main control unit 50 receives the music data MD1 transferred from the personal computer 12 via the communication unit 51, the main control unit 50 sends out and stores the music data MD1 to and in the storage unit 53. In this manner, the main control unit 50 is configured to store a plurality of pieces of the music data MD1 in the storage unit 53 (hereinafter, the music data MD1 stored in the storage unit 53 of the music robot device 11 in the above manner will be referred to as the music data MD2).

In addition to the above configuration, the main control unit 50 stores database (that is, the first motion pattern database ADB and the second motion pattern database BDB) same as the first motion pattern database ADB and the second motion pattern database BDB stored in the storage unit 42 of the personal computer 12 in the storage unit 53.

(6) Generation of Motion Data in Music Robot Device

Here, description will be made with respect to processing of generating the motion data UD2 for moving the entire music robot device 11 in parallel with the reproduction of the music when the music robot device 11 reproduces the music based on the music data MD2 stored in the storage unit 53. As the processing of generating the motion data UD2, there are second interval dividing processing for dividing the music data MD2 into the beat intervals (that is, the first bar intervals MS1 and the second bar intervals MS2) by simple processing although precision is lower as compared with the first interval dividing processing descried above, second characteristic detection processing for detecting the characteristic of the music data MD2 by simple processing although precision is lower as compared with the first characteristic detection processing, and second data allocation processing for allocating the motion pattern data to the interval of the music data MD2. The main control unit 50 of the music robot device 11 carries out the second interval dividing processing, the second characteristic detection processing, and the second data allocation processing in parallel to generate the motion data UD2. Hereinafter, the second interval dividing processing, the second characteristic detection processing, and the second data allocation processing will be sequentially described.

(6-1) First Interval Dividing Processing

First, the second interval dividing processing carried out by the main control unit 50 of the music robot device 11 will be described. When a command (hereinafter referred to as a stored music reproducing command) for reproducing the music data MD2 to be stored in the storage unit 53, for example, by contact of a finger and a hand of the user detected by the contact detection sensor unit 33 provided on a surface of the enclosure center part 21, the main control unit 50 starts the reproduction of the music data MD2 and also starts the second interval dividing processing in parallel with the reproduction of the music. The main control unit 50 detects a sound volume level of the music data MD2 in the second interval dividing processing. Then, the main control unit 50 detects the beat of the music when the music based on the music data MD2 is played, for example, by detecting a peak of the sound volume level by a threshold value.

At the second interval dividing processing, the control unit storage unit 53 sequentially divides the music data MD2 into any of the first bar intervals MS1 and the second bar intervals MS2 in accordance with the detected music beat in a similar manner as the first interval dividing processing described above, and when the music data MD2 is divided up to the end thereof, the second interval dividing processing will be terminated.

By the second interval dividing processing described above, the main control unit 50 is configured to sequentially divide the music data MD2 into the first bar intervals MS1 and the second bar intervals MS2. In this case, by dividing the music data MD2 into the first bar intervals MS1 and the second bar intervals MS2 by the second interval dividing processing that can process easily as compared with the first interval dividing processing by the controlling unit 40 of the personal computer 12, the main control unit 50 can divide the music data MD2 into the first bar intervals MS1 and the second bar intervals MS2 so as to follow the reproduction of the music data MD2 in real time.

(6-2) Second Characteristic Detection Processing

Next, the second characteristic detection processing carried out by the main control unit 50 of the music robot device 11 will be described. When a stored music reproducing command is input, the main control unit 50 starts the reproduction of the music data MD2 and also the second characteristic detection processing in parallel with the reproduction of the music. The main control unit 50 detects the sound volume level of the music data MD2 in the second characteristic detection processing. Then, the main control unit 50 detects the characteristic of the music based on the music data MD2 and generates the characteristic digitization information that expresses the detection result being digitized, for example, by timing time where states in which the sound volume level detected corresponding to the threshold value is high and low continue.

Then, at the second characteristic detection processing, the main control unit 50 sequentially generates the characteristic digitization information from the beginning of the music data MD2 in a similar manner as the first characteristic detection processing described above, and terminates the second characteristic detection processing when the characteristic digitization information is generated up to the end of the music data MD2.

By the second characteristic detection processing as described above, the main control unit 50 is configured to sequentially obtain the characteristic digitization information of the music data MD2. In this case, the main control unit 50 can detect the characteristic of the music data MD2 to generate the characteristic digitization information in such a manner as to follow the reproduction of the music data MD2 in real time, by detecting the characteristic of the music data MD2 by the second characteristic detection processing that can be processed easily as compared with the second characteristic detection processing carried out by the control unit 40 of the personal computer 12.

(6-3) Second Data Allocation Processing

Further, the second data allocation processing carried out by the main control unit 50 of the music robot device 11 will be described. When the stored music reproducing command is input, the main control unit 50 starts the reproduction of the music data MD2, and also starts the second data allocation processing in parallel with the reproduction of the music. Then, at the second data allocation processing, the main control unit 50 sequentially allocates the first motion pattern data AD and the second motion pattern data BD of each of the movable parts of six axes to the first bar intervals MS1 and the second bar intervals MS2 of the music data MD2 in a similar manner as the first data allocation processing described above, and terminates the second data allocation processing when the first motion pattern data AD and the second motion pattern data BD of each of the movable parts of six axes are allocated up to the first bar intervals MS1 and the second bar intervals MS2 at the end of the music data MD2.

By the second data allocation processing described above, the main control unit 50 is configured to sequentially allocate the first motion pattern data AD and the second motion pattern data BD to the first bar intervals MS1 and the second bar intervals MS2 of the music data MD2.

In the above manner, the main control unit 50 of the music robot device 11 sequentially generates, for example, the motion data UD2 of each of the first bar intervals MS1 and the second bar intervals MS2 of the music data MD2 by carrying out the second interval dividing processing, the second characteristic detection processing, and the second data allocation processing in parallel when the music data MD2 is reproduced. Then, the main control unit 50 can synchronize with the melody of the music based on the music data MD2 being reproduced and operate as though the music robot device 11 itself is dancing by carrying out the processing similar to when the music reproducing processing described above is carried out in accordance with the motion data UD2 sequentially generated in the above manner.

In the above case, the main control unit 50 divides the music data MD2 into the first bar intervals MS1 and the second bar intervals MS2 and also detects the characteristic of the music data MD2 to generate the characteristic digitization information by carrying out the second interval dividing processing and the second characteristic detection processing that can be processed easily as compared with the first interval dividing processing and the first characteristic detection processing carried out by the control unit 40 of the personal computer 12. Thereby, the main control unit 50 can generate the motion data UD2 by allocating the first motion pattern data AD and the second motion pattern data BD to the first bar intervals MS1 and the second bar intervals MS2 of the music data MD2 in such a manner as following the reproduction of the music data MD2 in real time.

In addition to the above, when the music data MD1 transferred from the personal computer 12 is received via the communication part 51, the main control unit 50 of the music robot device 11 can output and make the user capable of listening to the music based on the music data MD1 by applying the predetermined reproduction processing to the music data MD1 and sending out the music data MD1 to the right speaker 28 and the left speaker 29. Then, by carrying out the second interval dividing processing, the second characteristic detection processing, and the second data allocation processing described above in parallel with the processing of reproducing the music data MD1, the main control unit 50 can sequentially generate the motion data UD2. That is, the main control unit 50 sequentially generates the motion data UD2 of each of the first bar intervals and the second intervals of the music data MD1 by carrying out the second interval dividing processing, the second characteristic detection processing, and the second data allocation processing described above to the music data MD1 in parallel when the music data MD1 transferred from the personal computer 12 is reproduced as it is. The main control unit 50 can follow the melody of the music in real time based on the music data MD1 being reproduced to operate, by carrying out processing similar to the music reproducing processing described above in accordance with the motion data UD2 generated in the above manner.

In addition to the above configuration, a sound collector 54 is provided in the music robot device 11. By collecting sound of music played outside the music robot device 11 and carrying out predetermined processing such as analog-digital conversion, the sound collector 54 is configured to generate music data MD3 based on the outside music. Then, the sound collector 54 sends out the music data MD3 generated in the above manner to the main control unit 50.

When the music data MD3 is obtained from the sound collector 54, the main control unit 50 can also sequentially generate the motion data UD2 by carrying out the second interval dividing processing, the second characteristic detection processing, and the second data allocation processing described above in parallel. That is, the main control unit 50 carries out the second interval dividing processing, the second characteristic detection processing, and the second data allocation processing described above in parallel with respect to the music data MD3 generated based on the sound collecting of the music when the music is played outside, thereby the main control unit 50 sequentially generates the motion data UD2 of each bar interval of the first bar intervals and the second bar intervals of the music data MD3. By carrying out the processing similar to the music reproduction processing described above in accordance with the motion data UD2 generated in the above manner, the main control unit 50 can follow the melody of the music played outside in real time to operate.

Figure 17:
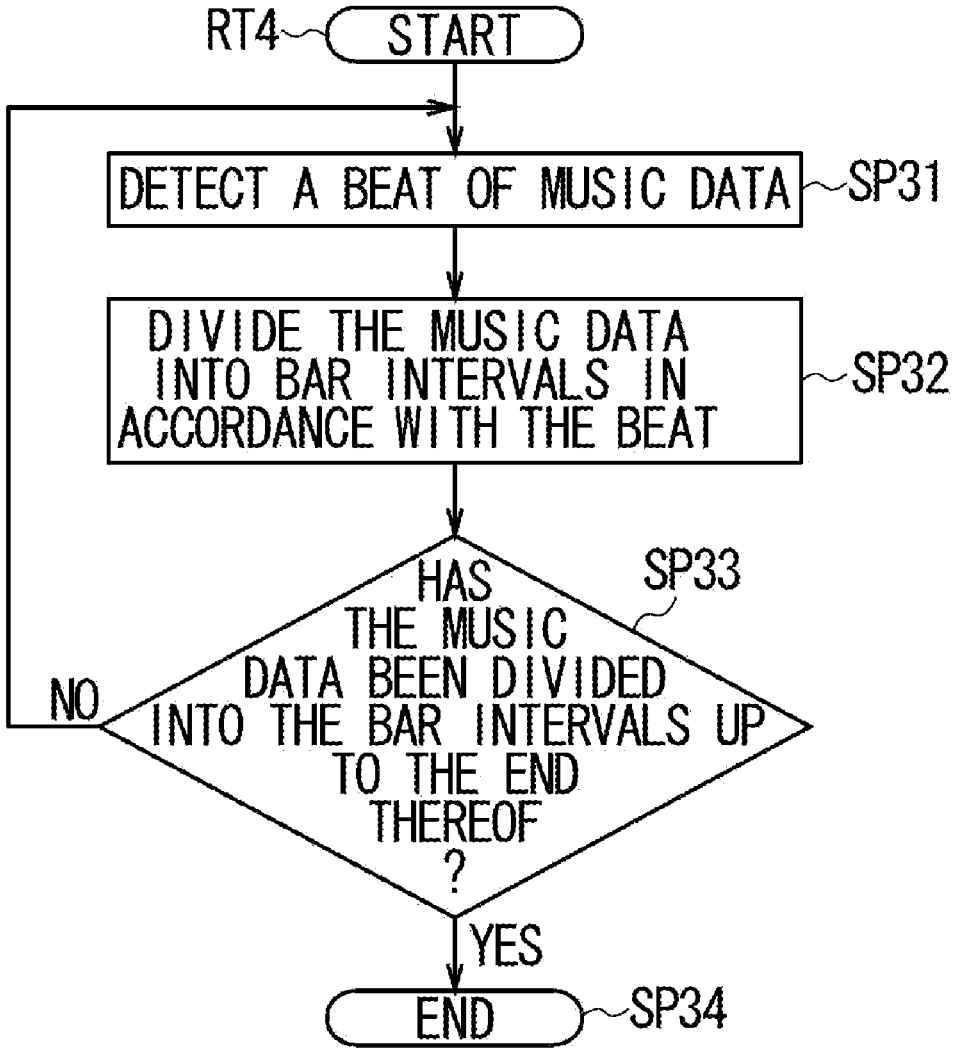
FIG. 17 is a flowchart showing a second interval dividing processing procedure.

(7) Description of Processing Procedure (7-1) Second Interval Dividing Processing Procedure Here, a procedure of the second interval dividing processing described above will be described. When the user inputs the stored music reproducing command, the music robot device 11 starts the reproduction of the music data MD2 and also a second interval dividing processing procedure RT4 as shown in FIG. 17. When the second interval dividing processing procedure RT4 is started, the main control unit 50 of the music robot device 11 detects the beat of the music data MD2 being reproduced in Step SP31, and the procedure moves to the next Step SP32.

In Step SP32, the main control unit 50 sequentially divides the music data MD2 into the first bar intervals MS1 and the second bar intervals MS2 in accordance with the detected beat, and then the procedure moves to the next Step SP33.

In Step SP33, the main control unit 50 determines whether or not the music data MD2 has been divided into the first bar intervals MS1 and the second bar intervals MS2 up to the end thereof. If a result is negative in Step SP33, this means that the music data MD2 has been still reproduced. Therefore, in this case, the main control unit 50 returns to Step SP31, and repeats the procedure from Step SP31 to Step SP33 described above until a positive result is obtained in Step SP33.

On the other hand, if the positive result is obtained in Step SP33, this means that the reproduction of the music data MD2 has already finished. Therefore, the main control unit 50 moves to the next Step SP34 and terminates the second interval dividing processing procedure RT4.

The main control unit 50 is configured to divide the music data MD2 into the first bar intervals MS1 and the second bar intervals MS2 in such a manner as following the reproduction of the music data MD2 in real time.

(7-2) Second Characteristic Detection Processing Procedure

Figure 18:
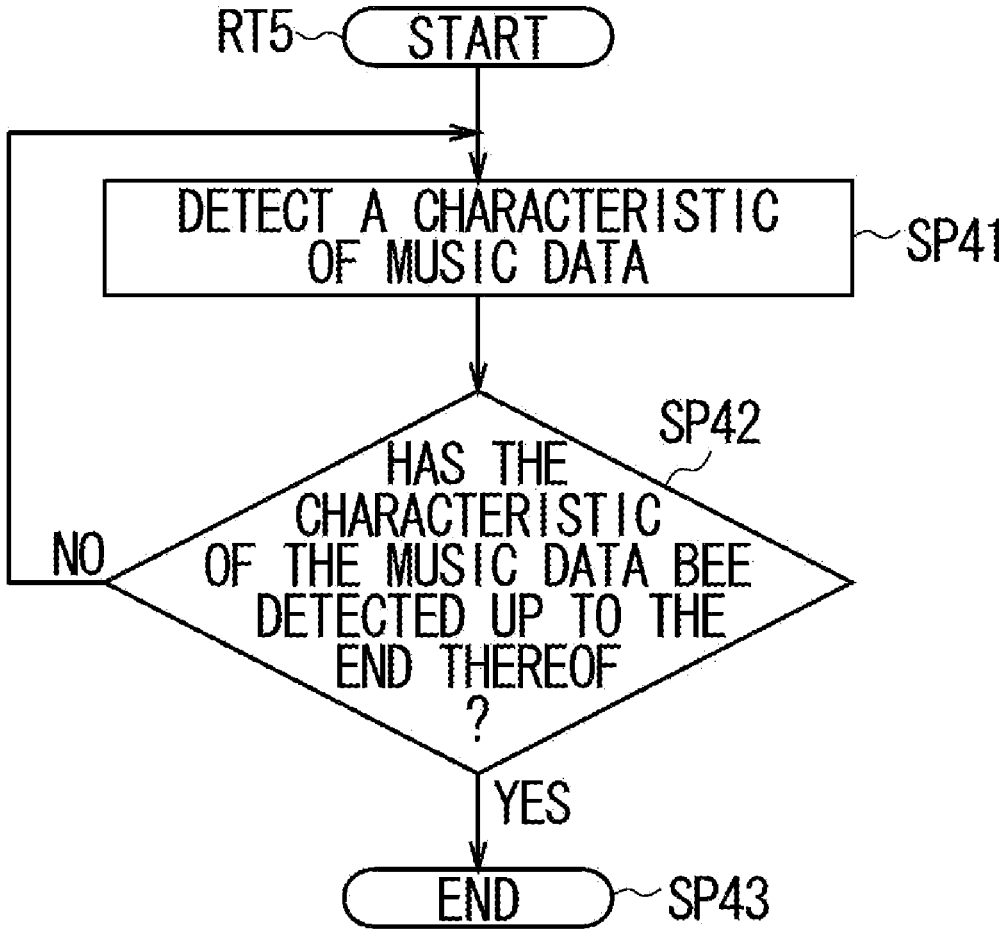
FIG. 18 is a flowchart showing a second characteristic detection processing procedure.

Next, a procedure of the second characteristic detection processing described above will be described. When the user inputs the stored music reproducing command, the music robot device 11 starts the reproduction of the music data MD2 and also a second characteristic detection processing procedure RT5 as shown in FIG. 18. When the second characteristic detection processing procedure RT5 is started, the main control unit 50 of the music robot device 11 detects the characteristic of the music data MD2 being reproduced and generates the characteristic digitization information in Step SP41, and the procedure moves to the next Step SP42.

In Step SP42, the main control unit 50 determines whether or not the characteristic of the music data MD2 has been detected up to the end thereof. If a result is negative in Step SP42, this means that the music data MD2 has been still reproduced. Therefore, in this case, the main control unit 50 returns to Step SP41, and repeats the procedure from Step SP41 to Step SP42 described above until a positive result is obtained in Step SP42.

On the other hand, if the positive result is obtained in Step SP42, this means that the reproduction of the music data MD2 has already finished. Therefore, the main control unit 50 moves to the next Step SP43 and terminates the second characteristic detection processing procedure RT5.

The main control unit 50 is configured to detect the characteristic of the music data MD2 and generates the characteristic digitization information in such a manner as following the reproduction of the music data MD2 in real time.

(7-3) Second Data Allocation Processing Procedure

Figure 19:
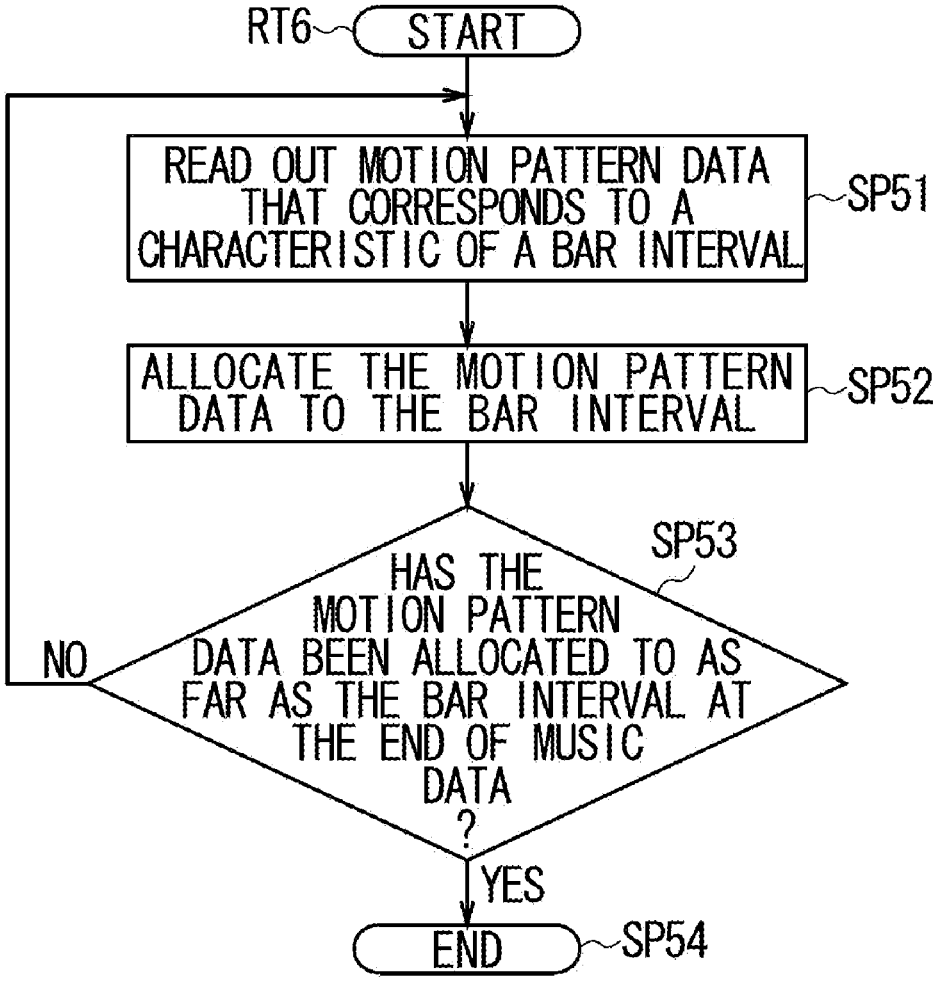
FIG. 19 is a flowchart showing a second data allocation processing procedure.

Further, a procedure of the second data allocation processing described above will be described. When the user inputs the stored music reproducing command, the music robot device 11 starts the reproduction of the music data MD2 and also a second data allocation processing procedure RT6 as shown in FIG. 19. When the second data allocation processing procedure RT6 is started, the main control unit 50 of the music robot device 11 reads out the first motion pattern data AD and the second motion pattern data BD of each of the movable part of six axes corresponding to the characteristics of the first bar intervals MS1 and the second bar intervals MS2 of the music data MD2 from the first motion pattern database ADB and the second motion pattern database BDB in accordance with the characteristic digitization information corresponding to the first bar intervals MS1 and the second bar intervals MS2 of the music data MD2 in Step SP51, and the procedure moves to the next Step SP52.

In Step SP52, the main control unit 50 sequentially allocates the first motion pattern data AD and the second motion pattern data BD of each of the movable part of six axes being read out to the first bar intervals MS1 and the second bar intervals MS2 of the music data MD2, and moves to the next Step S53.

In Step SP53, the main control unit 50 determines whether or not the first motion pattern data AD and the second motion pattern data BD of each of the movable part of six axes have been allocated to as far as the first bar intervals MS1 and the second bar intervals MS2 at the end of the music data MD2. If a result is negative in Step SP53, this means that the music data MD2 has been still reproduced. Therefore, in this case, the main control unit 50 returns to Step SP51, and repeats the procedure from Step SP51 to Step SP53 described above until a positive result is obtained in Step SP53.

On the other hand, if the positive result is obtained in Step SP53, this means that the reproduction of the music data MD2 has already finished. Therefore, the main control unit 50 moves to the next Step SP54 and terminates the second data allocation processing procedure RT6.

The main control unit 50 is configured to allocate the motion pattern data to the music data MD2 by the second data allocation processing procedure RT6.

(8) Operation and Advantageous Effect

In the above configuration, the control unit 40 of the personal computer 12 divides the music data MD1 into the first bar intervals MS1 and the second bar intervals MS2 by detecting the beat of the music based on the music data MD1, and also detects the characteristic of the music based on the music data MD1. Then, when the first motion pattern data AD of each of the movable parts of six axes corresponding to the first bar intervals MS1 of the music data MD1 is read out in accordance with the characteristic of the music, the control unit 40 modifies the first motion pattern data AD of each of the movable parts of six axes in such a manner as extending or shortening the motion performing time of the motion pattern so that the start and the end of the motion pattern based on the first motion pattern data AD of each of the movable parts of six parts being read out match with the beginning and the end of the interval of the first bar intervals MS1, and also allocates the first motion pattern data AD of each of the movable parts of six axes being modified to the first bar intervals MS1. In addition, at the first data allocation processing, when the second motion pattern data BD of each of the movable parts of six axes corresponding to the second bar intervals MS2 of the music data MD1 is read out, the control unit 40 modifies the second motion pattern data BD of each of the movable parts of six axes in such a manner as extending or shortening the motion performing time of the motion pattern so that the start and the end of the motion pattern based on the second motion pattern data BD of each of the movable parts of six parts being read out match with the beginning and the end of the interval of the second bar intervals MS2, and also allocates the second motion pattern data BD of each of the movable parts of six axes being modified to the second bar intervals MS2.

Therefore, when the control unit 40 finally generates the motion data UD1 corresponding to the first motion pattern data AD and the second motion pattern data BD of each of the movable parts of six axes being allocated, and controls the music robot device 11 to reproduce the motion data UD1 together with the music data MD1, the control unit 40 can control the music robot device 11 to operate in the motion pattern that starts from the beginning of and ends at the end of the first bar intervals MS1 and the second bar intervals MS2 corresponding to the bar interval when the music based on the music data MD1 is expressed in a musical note, and to move continuously in accordance with the melody of the music being reproduced without the motion pattern corresponding to the motion pattern data being interrupted unnaturally.

According to the above configuration, the personal computer 12 stores the first motion pattern data AD and the second motion pattern data BD corresponding to the predetermined motion pattern in the storage unit 42, and when the personal computer 12 analyzes the music data MD1 to detect the beat of the music based on the music data MD1 in order to divide the music data MD1 into a plurality of the first bar intervals MS1 and the second bar intervals MS based on the detected beat, the personal computer 12 generates the motion data UD1 corresponding to the music based on the music data MD1 in such a manner as allocating the first motion pattern data AD and the second motion pattern data BD of each of the movable parts of six axes to the first bar intervals MS1 and the second bar intervals MS2 of the divided music data MD1. In this manner, when the personal computer 12 controls the music robot device 11 to reproduce the motion data UD1 together with the music data MD1, the personal computer 12 can switch the motion pattern in synchronization with the switching of the first bar intervals MS1 and the second bar intervals MS2 corresponding to a bar when the music based on the music data MD1 is expressed in a musical score while a part of the music equivalent to the first bar intervals MS1 and the second bar intervals MS2 of the music data MD1 is being reproduced. In this manner, the personal computer can generate the motion data of the motion in synchronization with the melody of the music.

In addition, the music robot device 11 stores the first motion pattern data AD and the second motion pattern data BD corresponding to the predetermined motion pattern in the storage unit 53, and when the music robot device 11 analyzes the music data MD2 to detect the beat of the music based on the music data MD2 in order to divide the music data MD2 into a plurality of the first bar intervals MS1 and the second bar intervals MS2 based on the detected beat, the music robot device 11 generates the motion data UD2 corresponding to the music based on the music data MD2 in such a manner as allocating the first motion pattern data AD and the second motion pattern data BD of each of the movable parts of six axes to the first bar intervals MS1 and the second bar intervals MS2 of the divided music data MD2. In this manner, when the music robot device 11 reproduces the motion data UD2 together with the music data MD2, the music robot device 11 can switch the motion pattern in synchronization with the switching of the first bar intervals MS1 and the second bar intervals MS2 corresponding to a bar when the music based on the music data MD1 is expressed in a musical score while a part of the music equivalent to the first bar intervals MS1 and the second bar intervals MS2 of the music data MD2 is reproduced. In this manner, the music robot device 11 can generate the motion data of the motion in synchronization with the melody of the music.

Further, when the personal computer 12 allocates the first motion pattern data AD and the second motion pattern data BD to the first bar intervals MS1 and the second bar intervals MS2 of the music data MD1 divided corresponding to the beat, the personal computer 12 is configured to generate the motion data UD1 in a manner that the first motion pattern data AD and the second motion pattern data BD of each of the movable parts of six axes corresponding to the characteristic of a part of the music that corresponds to the first bar intervals MS1 and the second bar intervals MS2 of the music data MD1 are read out from the first motion pattern database ADB and the second motion pattern database BDB and allocated. In this manner, when the personal computer 12 controls the music robot device 11 to reproduce the motion data UD1 together with the music data MD1, the personal computer 12 can control the music robot device 11 to operate in the motion pattern in accordance with the characteristic of the part of the music equivalent to the first bar intervals MS1 and the second bar intervals MS2 of the music data MD1. Therefore, the personal computer 12 can generate the motion data of the motion that matches with an image and atmosphere of the music.

Further, when the music robot device 11 allocates the first motion pattern data AD and the second motion pattern data BD to the first bar intervals MS1 and the second bar intervals MS2 of the music data MD1 divided corresponding to the beat, the music robot device 11 is configured to generate the motion data UD2 in a manner that the first motion pattern data AD and the second motion pattern data BD of each of the movable parts of six axes corresponding to the characteristic of a part of the music that corresponds to the first bar intervals MS1 and the second bar intervals MS2 of the music data MD2 are read out from the first motion pattern database ADB and the second motion pattern database BDB and allocated. In this manner, when the music robot device 11 reproduces the motion data UD2 together with the music data MD1, the music robot device 11 can operate in the motion pattern in accordance with the characteristic of the part of the music equivalent to the first bar intervals MS1 and the second bar intervals MS2 of the music data MD2. Therefore, the music robot device 11 can generate the motion data of the motion that matches with an image and atmosphere of the music.

Further, when the personal computer 12 allocates the first motion pattern data AD and the second motion pattern data BD to the first bar intervals MS1 and the second bar intervals MS2 of the music data MD1 divided corresponding to the beat, the personal computer 12 is configured to generate the motion data UD1 in a manner that the same first motion pattern data AD is allocated to each of the movable parts of six axes with respect to the first bar intervals MS1 in which the same chord is detected among a plurality of the first bar intervals MS1 of the music data MD1, and also the same second motion pattern data BD is allocated to each of the movable parts of six axes with respect to the second bar intervals MS2 in which the same chord is detected among a plurality of the second bar intervals MS2 of the music data MD1. In this manner, when the personal computer 12 controls the music robot device 11 to reproduce the motion data UD1 together with the music data MD1, the personal computer 12 can control the music robot device 11 to operate in the same motion pattern, for example, at a part formed by the same chord such as a repeated part in the music based on the music data MD1. Therefore, the personal computer 12 can demonstrate that as though the music robot device 11 itself moves with intelligence.

Further, when the music robot device 11 allocates the first motion pattern data AD and the second motion pattern data BD to the first bar intervals MS1 and the second bar intervals MS2 of the music data MD2 divided corresponding to the beat, the music robot device 11 is configured to generate the motion data UD2 in a manner that the same first motion pattern data AD is allocated to each of the movable parts of six axes with respect to the first bar intervals MS1 in which the same chord is detected among a plurality of the first bar intervals MS1 of the music data MD2, and also the same second motion pattern data BD is allocated to each of the movable parts of six axes with respect to the second bar intervals MS2 in which the same chord is detected among a plurality of the second bar intervals MS2 of the music data MD2. In this manner, when the music robot device 11 reproduces the motion data UD2 together with the music data MD2, the music robot device 11 operates in the same motion pattern, for example, at a part formed by the same chord such as a repeated part in the music based on the music data MD2. Therefore, the music robot device 11 can demonstrate that as though the music robot device 11 itself moves with intelligence.

Further, when the personal computer 12 allocates the first motion pattern data AD and the second motion pattern data BD to the first bar intervals MS1 and the second bar intervals MS2 of the music data MD1 divided corresponding to the beat, the personal computer 12 is configured to generate the motion data UD1 in a manner by allocating the first motion pattern data AD and the second motion pattern data BD of each of the movable parts of six axes being modified so that the start and the end of each of the motion patterns based on the first motion pattern data AD and the second motion pattern data BD of each of the movable parts of six axes match with the beginning and the end of each of the first bar intervals MS1 and the second bar intervals MS2 of the music data MD1. In this manner, when the personal computer 12 controls the music robot device 11 to reproduce the motion data UD1 together with the music data MD1, the personal computer 12 can control the music robot device 11 to operate in the motion pattern that starts from the beginning of and finishes at the end of the first bar intervals MS1 and the second bar intervals MS2 corresponding to a bar when the music based on the music data MD1 is expressed in a musical score. Therefore, the personal computer 12 can control the music robot device 11 to move continuously in accordance with the melody of the music being reproduced without the motion pattern corresponding to the motion pattern data being interrupted unnaturally.

Further, when the music robot device 11 allocates the first motion pattern data AD and the second motion pattern data BD to the first bar intervals MS1 and the second bar intervals MS2 of the music data MD2 divided corresponding to the beat, the music robot device 11 is configured to generate the motion data UD2 in a manner by allocating the first motion pattern data AD and the second motion pattern data BD of each of the movable parts of six axes being modified so that the start and the end of each of the motion patterns based on the first motion pattern data AD and the second motion pattern data BD of each of the movable parts of six axes match with the beginning and the end of each of the first bar intervals MS1 and the second bar intervals MS2 of the music data MD2. In this manner, when the music robot device 11 reproduces the motion data UD2 together with the music data MD2, the music robot device 11 operates in the motion pattern that starts from the beginning of and finishes at the end of the first bar intervals MS1 and the second bar intervals MS2 corresponding to a bar when the music based on the music data MD2 is expressed in a musical score. Therefore, the music robot device 11 can move continuously in accordance with the melody of the music being reproduced without the motion pattern corresponding to the motion pattern data being interrupted unnaturally.

(9) Other Embodiments

In the embodiment described above, the description was made with respect to the case where the first motion pattern data AD and the second motion pattern data BD are allocated after being modified so that the start and the end of each of the motion patterns based on the first motion pattern data AD and the second motion pattern data BD match with the beginning and the end of each of the first bar intervals MS1 and the second bar intervals MS2 of the music data MD1 or the music data MD2. However, the present invention is not limited thereto, and the way of the allocation is not limited specifically as long as the music robot device 11 moves in a manner that the motion patterns based on the first motion pattern data AD and the second motion pattern data BD are completed within the first bar intervals MS1 and the second bar intervals MS2 of the music data MD1 or the music data MD2.

In addition, in the embodiment described above, the description was made with respect to the case where the first motion pattern data AD and the second motion pattern data BD of each of the movable parts of six axes are combined when the motion data UD1 and the motion data UD2 are generated. However, the present invention is not limited thereto, and the first motion pattern data AD and the second motion pattern data BD of each of the movable parts of six axes may be combined separately for each of the movable parts, or may be screened to be combined for a plurality of the movable parts. In addition, the number of the movable parts is not limited to six axes, and not limited specifically. Further, in this case, if the first light emitting pattern data and the second light emitting pattern data that emits light from the right light emitting part 34 and the left light emitting part 35 in the predetermined light emitting pattern are stored, and the first light emitting pattern data and the second light emitting pattern data are also combined when the motion data UD1 and the motion data UD2 are generated, the music robot device 11 is controlled to emit light from the right light emitting part 34 and the left light emitting part 35 in the predetermined light emitting pattern in synchronization with the music, and to express in a variety of ways.

Further, in the embodiment described above, the description was made with respect to the case where the music data MD1 transferred from the personal computer 12 is reproduced as it is and also the motion data UD2 is generated together therewith, and the music robot device 11 is controlled to operate so as to follow the music based on the music data MD1 being reproduced in accordance with the motion data UD2. However, the present invention is not limited thereto, and the music data MD1 transferred from the personal computer 12 may be stored temporarily in a buffer for a period of time required for generating the motion data UD2, and the start of the reproduction of the music data MD1 and the motion data UD2 may be synchronized. In this manner, the music robot device 11 can be operated in synchronization with the music based on the music data MD1 being reproduced with high precision.

Further, in the embodiment descried above, the description was made with respect to the case where, in the music robot device 11, the music data MD2 is divided into the first bar intervals MS1 and the second bar intervals MS2 and also the characteristic of the music data MD2 is detected to generate the characteristic digitization information by the second interval dividing processing and the second characteristic detection processing that can be processed easily as compared with the first interval dividing processing and the first characteristic detection processing for the personal computer 12. However, the present invention is not limited thereto, and the music data MD2 may be divided into the first bar intervals MS1 and the second bar intervals MS2 and also the characteristic of the music data MD2 may be detected to generate the characteristic digitization information by the first interval dividing processing and the first characteristic detection processing for the personal computer 12, if the main control unit 50 of the music robot device 11 has a sufficient processing ability. In this manner, the music robot device 11 can be controlled to generate the motion data of the motion that can synchronize with the music with high precision as much as when generated by the personal computer 12.

Further, in the description described above, the description was made with respect to the case where an interval of four beats as a whole formed in such a manner that three beats are located between dividing beats is the first bar intervals MS1, and an interval of eight beats as a whole formed in such a manner that seven beats are located between the dividing beats is the second bar intervals MS2. However, the present invention is not limited thereto, and length of the interval (that is, how many beats are located) of the first bar intervals MS1 and the second bar intervals MS2 is not limited, and there may be two or more types of the bar intervals. In this manner, for example, the motion pattern data can be allocated to an interval of the music of three beats as a whole (that is, a bar of the music corresponding to three beats) and an interval of the music of five beats as a whole (that is, a bar of the music corresponding to five beats) in accordance with three beats, five beats, and so on frequently used for classical music. By controlling the motion data to be generated by the motion pattern data allocated in the above manner, the music robot device 11 can be moved more in synchronization with the music.

Further, in the embodiment described above, the description was made with respect to the case where the bar intervals of the music data is divided in accordance with the beat of the music, and the motion pattern data of each of the bar intervals of the music is read out in accordance with the characteristic of the music. However, the present invention is not limited thereto, and the bar intervals of the music data may be divided in accordance with the characteristic of the music, and the motion pattern data of each of the bar intervals of the music may be read out in accordance with the beat of the music. The way of dividing the bar intervals of the music and the way of reading out the motion pattern data of each of the bar intervals of the music are not limited.

Further, in the embodiment described above, the description was made with respect to the case where information of the tempo of the music is obtained by the characteristic digitization information generated from a result of detecting the characteristic of the music. However, the present invention is not limited thereto, and the information of the tempo of the music may be obtained from the beat of the music.

Further, in the embodiment described above, the description was made with respect to the case where the tempo of the music and the chord of the music are applied as a group of the characteristic of the music. However, the present invention is not limited thereto, and all groups that can be detected as the characteristic of the music, such as a genre of the music such as classical music and jazz, atmosphere of the music such as bright music and gloomy music, a music instrument and voice that are used in the music such as piano solo and a cappella, and a phrase of the music, such as a main melody and a countermelody can be applied.

In addition, in the embodiment described above, the description was made with respect to the case where the chord of the music of the first bar intervals MS1 and the second bar intervals MS2 and the identifiers of the first motion pattern data AD and the second motion pattern data BD of each of the movable parts of six axes corresponding to the chord of the music are stored as the historical information. However, the present invention is not limited thereto, and a genre of the music such as classical music and jazz, atmosphere of the music such as bright music and gloomy music, a music instrument and voice that are used in the music such as piano solo and a cappella, a phrase of the music, such as a main melody and a countermelody, and so on, and the identifiers of the first motion pattern data AD and the second motion pattern data BD of each of the movable parts of six axes corresponding thereto may be stored as the historical information. Alternatively, in this case, a plurality of pieces of historical information may be collectively stored. Further, in the above case, if a clock part is provided in the personal computer 12 and the music robot device 11 to count time, information of morning, afternoon, and night according to the time at which the music data is reproduced and the identifiers of the first motion pattern data AD and the second motion pattern data BD of each of the movable parts of six axes corresponding thereto can be stored as the historical information. Then, the historical information stored in the above manner may be deleted at the time when the reproduction of the music data finishes, may be deleted at the time when the power of the music robot device 11 is turned off, or may be left by being added to a database.

Further, in the embodiment described above, the description was made with respect to the case where the first motion pattern data AD and the second motion pattern data BD are associated with the characteristic of the music and put in a database as the attribute information. However, the present invention is not limited thereto, and the characteristic of the music as the attribute information may be added to the first motion pattern data AD and the second motion pattern data BD.

Further, in the embodiment described above, the description was made with respect to the case where although the motion data generated in accordance with the music data is reproduced together with the music data, the motion data is not left stored in association with the music data. However, the present invention is not limited thereto, and the motion data may be associated with the music data and stored together with the music data. In this manner, an effort to generate the motion data every time the music data is reproduce can be omitted, and usability can be improved.

Further, in the embodiment described above, the description was made with respect to the case where a database same as the first motion pattern database ADB and the second motion pattern database BDB stored in the storage unit 42 of the personal computer 12 is stored in the storage unit 53 of the music robot device 11. However, the present invention is not limited thereto, and the database to be stored in the storage unit 53 of the music robot device 11 may be the one with the number of pieces of the first motion pattern data AD and the second motion pattern data BD being associated less than the first motion pattern database ADB and the second motion pattern database BDB. In this manner, the capacity of the memory mounted in the music robot device 11 can be made little, and space in the enclosure of the music robot device 11 can be saved and cost can be reduced.

Further, in the embodiment described above, the description was made with respect to the case where the motion data generation device according to the present invention is applied to the music robot device 11 and the personal computer 12 described above with respect to FIGS. 1 to 19. However, the present invention is not limited thereto, and can be applied to the motion data generation devices of a variety of other forms, such as an audio player of a hard disk type, a portable audio player, and a mobile phone, as long as these devices can generate the motion data corresponding to the music data.

Further, in the embodiment described above, the description was made with respect to the case where the storage unit 42 and the storage unit 53 described above with respect to FIGS. 1 to 19 are applied as the storage unit that stores the motion pattern data corresponding to the predetermined motion pattern. However, the present invention is not limited thereto, and a storage unit having a variety of other configurations, such as an externally-mounted nonvolatile memory, an optical disc recording media including a CD and Digital Versatile Disc (DVD) can be widely applied.

Further, in the embodiment described above, the description was made with respect to the case where the control unit 40 and the main control unit 50 described above with respect to FIGS. 1 to 19 are applied as the beat detection unit that analyzes the music data to detect the beat of the music based on the music data. However, the present invention is not limited thereto, and a beat detection unit having a variety of other configurations, such as a beat detection circuit, and so on having a hardware configuration that analyzes the music data to detect the beat of the music based on the music data can be widely applied.

Further, in the embodiment described above, the description was made with respect to the case where the control unit 40 and the main control unit 50 described above with respect to FIGS. 1 to 19 are applied as the interval dividing part that divides the music data into a plurality of the beat intervals based on the beat detected by the beat detection unit. However, the present invention is not limited thereto, and an interval dividing unit having a variety of other configurations, such as the interval dividing circuit having a hardware configuration that divides the music data into a plurality of the beat intervals based on the beat detected by the beat detection unit can be widely applied.

Further, in the embodiment described above, the description was made with respect to the case where the control unit 40 and the main control unit 50 described above with respect to FIGS. 1 to 19 are applied as the data allocation unit that allocates the motion pattern data stored in the storage unit to the beat interval of the music data divided by the interval dividing unit. However, the present invention is not limited thereto, and a data allocation unit having a variety of other configurations such as a data allocation circuit having a hardware configuration that allocates the motion pattern data stored in the storage unit to the beat interval of the music data divided by the interval dividing unit can be widely applied.

Further, in the embodiment described above, the description was made with respect to the case where the control unit 40 and the main control unit 50 described above with respect to FIGS. 1 to 19 are applied as the data generation unit that generates the motion data in accordance with the motion pattern data allocated to the beat interval of the music data by the data allocation unit. However, the present invention is not limited thereto, and a data generation unit having a variety of other configurations such as a data generation circuit having a hardware configuration that generates the motion data in accordance with the motion pattern data allocated to the beat interval of the music data by the data allocation unit can be widely applied.

Further, in the embodiment described above, the control unit 40 and the main control unit 50 described above with respect to FIGS. 1 to 19 are applied as the characteristic detection unit that detects the characteristic of the music. However, the present invention is not limited thereto, and a characteristic detection unit having a variety of other configurations, such as a characteristic detection circuit having a hardware configuration that detects the characteristic of the music can be widely applied.

Further, in the embodiment described above, the description was made with respect to the case where the enclosure right rotational unit 22, the enclosure left rotational unit 23, the enclosure right opening/closing unit 24, the enclosure left opening/closing unit 25, the right wheel 30, and the left wheel 31 described above with respect to FIGS. 1 to 19 are applied as the movable parts that can move in the motion pattern. However, the present invention is not limited thereto, and a movable part having a variety of other configurations, such as the right light emitting part 28, the left light emitting part 29 can be widely applied.

Further, in the embodiment described above, the description was made with respect to the case where the drive control unit 52 described above with respect to FIGS. 1 to 19 is applied as the drive control unit that controls drive of the movable part. However, the present invention is not limited thereto, and a drive control unit having a variety of other configurations, such as a Central Processing Unit (CPU), a microcomputer, a drive control circuit having a hardware configuration that controls drive of the movable part can be widely applied.

Further, in the embodiment described above, the description was made with respect to the case where a variety of programs, such as a basic program, an application program, a control program, a motion data generation program are stored in an internal memory, the storage unit 42, and the storage unit 53. However, the present invention is not limited thereto, and a variety of programs, such as the basic program, the application program, the control program, the motion data generation program may be stored in a variety of recording media, such as an optical disc recording medium such as the CD and the DVD, the hard disk recording medium in the personal computer, a recording medium including a portable hard disk and a flash memory, so that the variety of programs may be read out from the recording media to be executed, or may be installed from the recording media to the internal memory, the storage unit 42, and the storage unit 53.

The present invention can be used for a music robot device that has a reproducing function of music data.

It should be understood by those skilled in the art that various modifications, combinations, sub-combinations and alterations may occur depending on design requirements and other factors insofar as they are within the scope of the appended claims or the equivalents thereof.

What is claimed is:

1. A motion data generation device comprising:

a storage unit that stores a plurality of motion pattern datasets, each motion pattern dataset corresponding to a predetermined motion pattern;

a beat detection unit that analyses music data and detects a beat of music based on the music data;

an interval dividing unit that divides the music data into a plurality of beat intervals based on the beat detected by the beat detection unit;

a data allocation unit that allocates to each beat interval of the music data a motion pattern dataset from among the plurality of motion pattern datasets stored in the storage unit and extends or contracts a motion pattern corresponding to said allocated motion pattern dataset so that a pattern start and a pattern end of said motion pattern match with a beat beginning and a beat end of said beat interval of the music data; and a data generation unit that generates motion data in accordance with the motion pattern dataset allocated to each respective beat interval of the music data by the data allocation unit.

2. The motion data generation device according to claim 1, comprising a characteristic detection unit that detects a characteristic of the music, wherein the storage unit stores attribute information of the motion pattern data in advance, and the data allocation unit allocates the motion pattern data stored in the storage unit to the beat intervals of the music data divided by the interval dividing unit based on a characteristic of the music detected by the characteristic detection unit and the attribute information of the motion pattern data stored in the storage unit.

3. The motion data generation device according to claim 2, wherein the characteristic detection unit detects the characteristic of the beat intervals of the music in accordance with a tempo of the music.

4. The motion data generation device according to claim 2, comprising a historical information generation unit that generates historical information of the motion pattern data in accordance with use of the motion pattern data, wherein the storage unit stores the historical information of the motion pattern data generated by the historical information generation unit, and the data allocation unit allocates the motion pattern data stored in the storage unit to the beat intervals of the music data divided by the interval dividing unit based on a characteristic of the music detected by the characteristic detection unit, and the attribute information and the historical information of the motion pattern data stored in the storage unit.

5. The motion data generation device according to claim 1, comprising:

a movable part that can move in the motion pattern; and a drive control unit that controls drive of the movable part, wherein the drive control unit controls drive of the movable part in accordance with the music depending on the motion data generated by the data generation unit, and the movable part can move in accordance with the music in the motion pattern depending on the motion data by the drive control of the drive control unit.

6. The motion data generation device according to claim 5, wherein the movable part comprises at least one of a wheel part, an opening/closing part, and a rotational part.

7. The motion data generation device according to claim 6, comprising a sound collector that collects sound of outside music and generates the music data, wherein the beat detection unit analyses the music data collected by the sound collector and detects the beat of music based on the music data.

8. A motion data generation method comprising:

a data generation step of analyzing music data;

detecting a beat of music based on the music data, and dividing the music data into a plurality of beat intervals based on the detected beat;

allocating to each beat interval a motion pattern, said motion pattern having a beginning and and end;

for each beat interval, extending or contracting the corresponding motion pattern such that the start and end of said motion pattern correspond to a beginning of the beat interval and an end of the beat interval, respectively; and generating motion data in accordance with allocation of motion pattern data corresponding to a predetermined motion pattern to the beat intervals of the divided music data.

9. A recording medium for recording a motion data generation program for allowing a computer to execute:

a data generation step of analyzing music data;

detecting a beat of music based on the music data;

dividing the music data into a plurality of beat intervals based on the detected beat;

allocating to each beat interval a motion pattern, said motion pattern having a beginning and an end;

for each beat interval, extending or contracting the corresponding motion pattern such that the start and end of said motion pattern correspond to a beginning of the beat interval and an end of the beat interval, respectively; and generating motion data in accordance with allocation of motion pattern data corresponding to a predetermined motion pattern to the beat intervals of the divided music data.

* * * * *